US010326213B2

(12) United States Patent
Parekh

(10) Patent No.: US 10,326,213 B2
(45) Date of Patent: Jun. 18, 2019

(54) MULTI-BAND ANTENNA FOR COMMUNICATION WITH MULTIPLE CO-LOCATED SATELLITES

(71) Applicant: VIASAT, INC., Carlsbad, CA (US)

(72) Inventor: Sharad V Parekh, Frisco, TX (US)

(73) Assignee: VIASAT, INC., Carlsbad, CA (US)

( * ) Notice: Subject to any disclaimer, the term of this patent is extended or adjusted under 35 U.S.C. 154(b) by 521 days.

(21) Appl. No.: 14/973,705

(22) Filed: Dec. 17, 2015

(65) Prior Publication Data

US 2017/0179597 A1 Jun. 22, 2017

(51) Int. Cl.

| | |
|---|---|
| ***H01Q 5/364*** | (2015.01) |
| ***H01Q 13/02*** | (2006.01) |
| ***H01Q 25/04*** | (2006.01) |
| ***H01Q 3/02*** | (2006.01) |
| ***H01Q 19/13*** | (2006.01) |
| ***H01Q 5/55*** | (2015.01) |

(52) U.S. Cl.

CPC ..... *H01Q 25/04* (2013.01); *H01Q 3/02* (2013.01); *H01Q 5/55* (2015.01); *H01Q 13/0275* (2013.01); *H01Q 19/132* (2013.01)

(58) Field of Classification Search

CPC ..... H01Q 13/025; H01Q 13/0275; H01Q 13/0283; H01Q 19/132; H01Q 25/04; H01Q 3/02; H01Q 5/364; H01Q 5/55

See application file for complete search history.

(56) References Cited

U.S. PATENT DOCUMENTS

| | | | |
|---|---|---|---|
| 5,635,944 A | 6/1997 | Weinstein et al. | |
| 5,793,334 A * | 8/1998 | Anderson | H01Q 13/02 333/126 |
| 6,008,483 A | 12/1999 | McKee et al. | |
| 6,208,312 B1 | 3/2001 | Gould | |
| 6,501,434 B1 | 12/2002 | Hollenstein et al. | |
| 6,621,375 B2 | 9/2003 | Vezmar et al. | |
| 6,937,202 B2 | 8/2005 | Chandler | |
| 8,248,321 B2 | 8/2012 | Anderson et al. | |
| 8,487,826 B2 | 7/2013 | Cook | |
| 8,730,119 B2 | 5/2014 | Runyon et al. | |
| 8,866,564 B2 | 10/2014 | Monte | |

(Continued)

FOREIGN PATENT DOCUMENTS

CN 203232958 U 10/2013

OTHER PUBLICATIONS

Wen Geyi et al., Compact Multi-Feed Multi-Band Antenna Designs for Wireless Mobile Devices, Antennas and Propagation Society International Symposium, 2007 IEEE, Jun. 9-15, 2007, pp. 1036-1039.

*Primary Examiner* — Hai V Tran

*Assistant Examiner* — Michael M Bouizza

(74) *Attorney, Agent, or Firm* — Fountainhead Law Group P.C.

(57) ABSTRACT

The present disclosure describes a multi-band antenna having a horn configured to communicate signals in a first frequency band and a second frequency band, an in-line feed, and sidewall feeds. The in-line feed may be coupled to an in-line opening in the horn to communicate signals in the first frequency band. The horn may include first and second openings to communicate signals in the second frequency band. The sidewall feeds may have first and second side feeds respectively coupled to the first and second openings.

15 Claims, 15 Drawing Sheets

(56) References Cited

U.S. PATENT DOCUMENTS

| | | | | |
|---|---|---|---|---|
| 2003/0151467 | A1 | 8/2003 | Vezmar et al. | |
| 2006/0119452 | A1* | 6/2006 | Kim | H01P 5/227 333/117 |
| 2010/0194655 | A1* | 8/2010 | Cook | H01P 1/17 343/756 |
| 2013/0342390 | A1 | 12/2013 | Cha et al. | |
| 2014/0057576 | A1 | 2/2014 | Monte et al. | |
| 2015/0097747 | A1 | 4/2015 | Hwang et al. | |

* cited by examiner

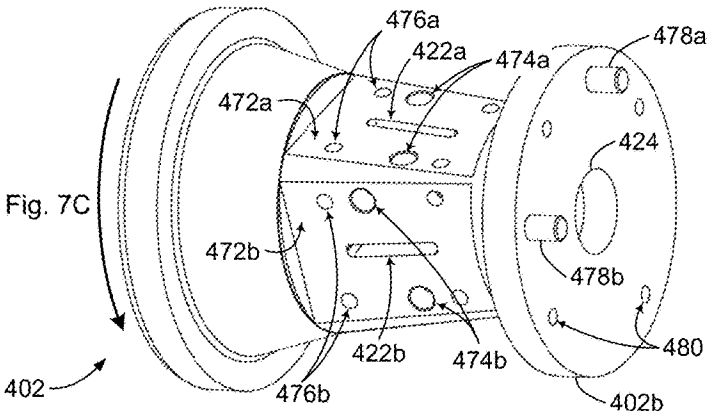
Fig. 7B
Fig. 7C
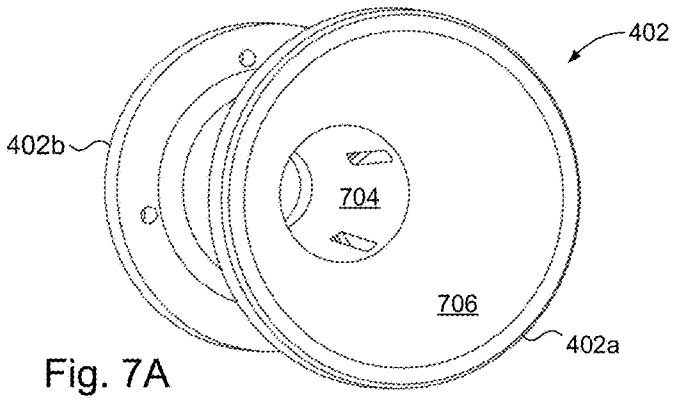
Fig. 7A
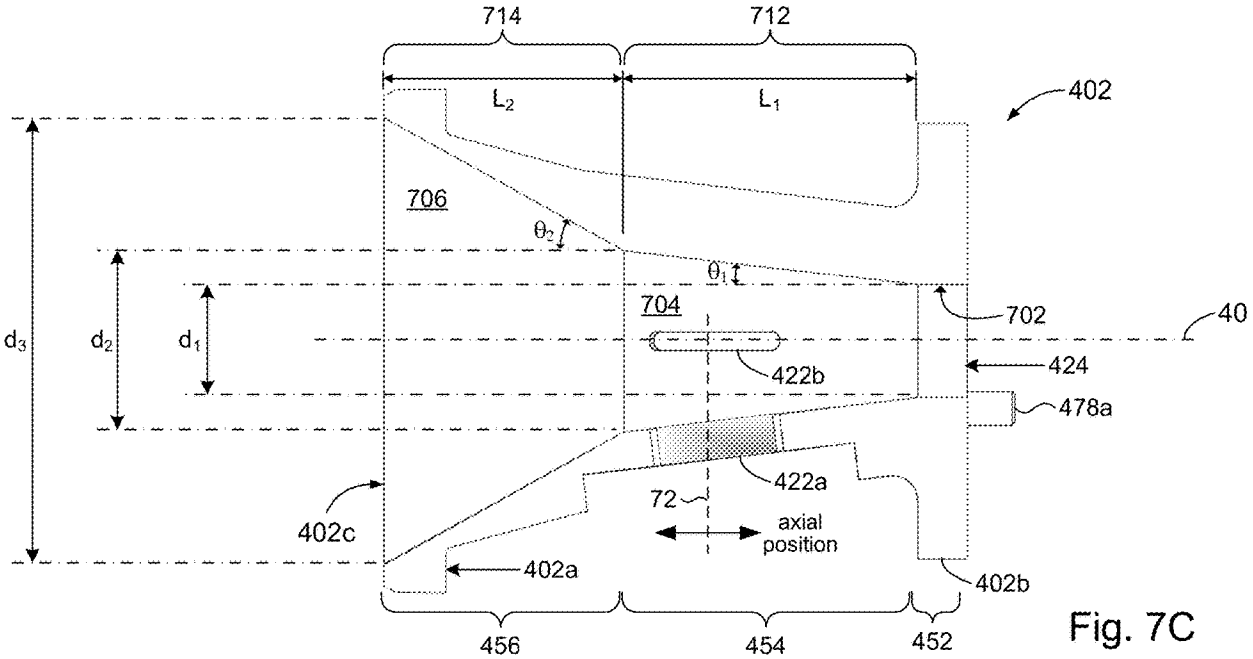
Fig. 7C

MULTI-BAND ANTENNA FOR COMMUNICATION WITH MULTIPLE CO-LOCATED SATELLITES

BACKGROUND

Satellite communication using earth terminal antennas for consumers and for enterprise applications typically are reflector type and typically are on the order of 0.6 m to 1.2 m in size. The typical consumer antenna size may be approximately 0.6 m to 0.75 m, and prime fed offset parabolic reflector configurations are often used because it offers a low cost solution. A feed antenna, typically a horn type, is located at the focal point of the parabolic reflector. When operating with multi-band communication satellite payloads or multiple co-located satellites, it may be desirable to have coincident or near coincident earth terminal beams that correspond to the communication bands. When the communication bands are Ku, K, and Ka, for example, it may be desirable that the beams are near coincident beams at all three bands, which for example, may span 10.7 to 30.0 GHz. In addition, the polarization requirements at K and Ka bands are generally dual circular polarization (CP). At the Ku band, the polarization may be dual CP or may be dual linear polarization (LP).

SUMMARY

The following detailed description and accompanying drawings provide a better understanding of the nature and advantages of the present disclosure.

In accordance with the present disclosure, a multi-band antenna may include a horn to communicate signals in a first frequency band and a lower second frequency band, an in-line feed, and a single pair of sidewall feeds consisting of a first side feed and a second side feed. The horn may include a flared section comprising a plurality of transition regions between a first end and a second end. The horn may further include an in-line opening at the first end of the flared section. The in-line feed may be coupled to the in-line opening to communicate signals in the first frequency band. The horn may further include first and second openings to communicate signals in the second frequency band. The first and second opening may be formed through the smooth interior surface of one of the transition regions and arranged asymmetrically about the central axis of the horn. The first and second side feeds of the single pair of sidewall feeds respectively coupled to the first and second openings. The horn may further include a dielectric member along the central axis of the horn and extending through each of the plurality of transition regions of the flared section.

In accordance with the present disclosure, a multi-band antenna may include means for propagating signals in a first frequency band and a second frequency band, means for coupling signals in the first frequency band to the means for propagating in order to propagate signals along a central axis of the means for propagating, means for coupling signals in the second frequency band to first and second openings formed through a sidewall of the means for propagating and arranged asymmetrically about the central axis of the means for propagating. The means for coupling may consist of means for feeding first signals in the second frequency band coupled to the first opening and means for feeding second signals in the second frequency band coupled to the second opening, the means for feeding first signals and the means for feeding second signals associated with respective orthogonal polarizations. The multi-band antenna may further include means for reducing off-axis cross-polarization in signals in the first frequency band.

In accordance with the present disclosure, a method of designing a multi-band antenna may include selecting dimensions for a first flared section of a horn, including a length dimension and a flare angle. Dimensions may be selected for a second flared section of the horn, including a length dimension and a flare angle. The method may include determining a location on either the first flared section or on the second flared section to form exactly two sidewall feeds and selecting dimensions for a dielectric member to be axially positioned within the horn. The method may include iteratively adjusting the dimensions of the first flared section and the second flared section until a beamwidth of a signal in a first frequency band is approximately equal to a first predetermined beamwidth and a beamwidth of a signal in a second frequency band is approximately equal to a second predetermined beamwidth and iteratively adjusting dimensions of the dielectric member until a cross-polarization of the signal in the first frequency band is less than or equal to a predetermined cross-polarization value.

BRIEF DESCRIPTION OF THE DRAWINGS

With respect to the discussion to follow and in particular to the drawings, it is stressed that the particulars shown represent examples for purposes of illustrative discussion, and are presented in the cause of providing a description of principles and conceptual aspects of the present disclosure. In this regard, no attempt is made to show implementation details beyond what is needed for a fundamental understanding of the present disclosure. The discussion to follow, in conjunction with the drawings, makes apparent to those of skill in the art how embodiments in accordance with the present disclosure may be practiced. In the accompanying drawings:

FIGS. 7A, 7B, and 7C show details of a flared section in accordance with various embodiments of the present disclosure.

DETAILED DESCRIPTION

In the following description, for purposes of explanation, numerous examples and specific details are set forth in order to provide a thorough understanding of the present disclosure. It will be evident, however, to one skilled in the art that the present disclosure as expressed in the claims may include some or all of the features in these examples, alone or in combination with other features described below, and may further include modifications and equivalents of the features and concepts described herein.

Figure 1:
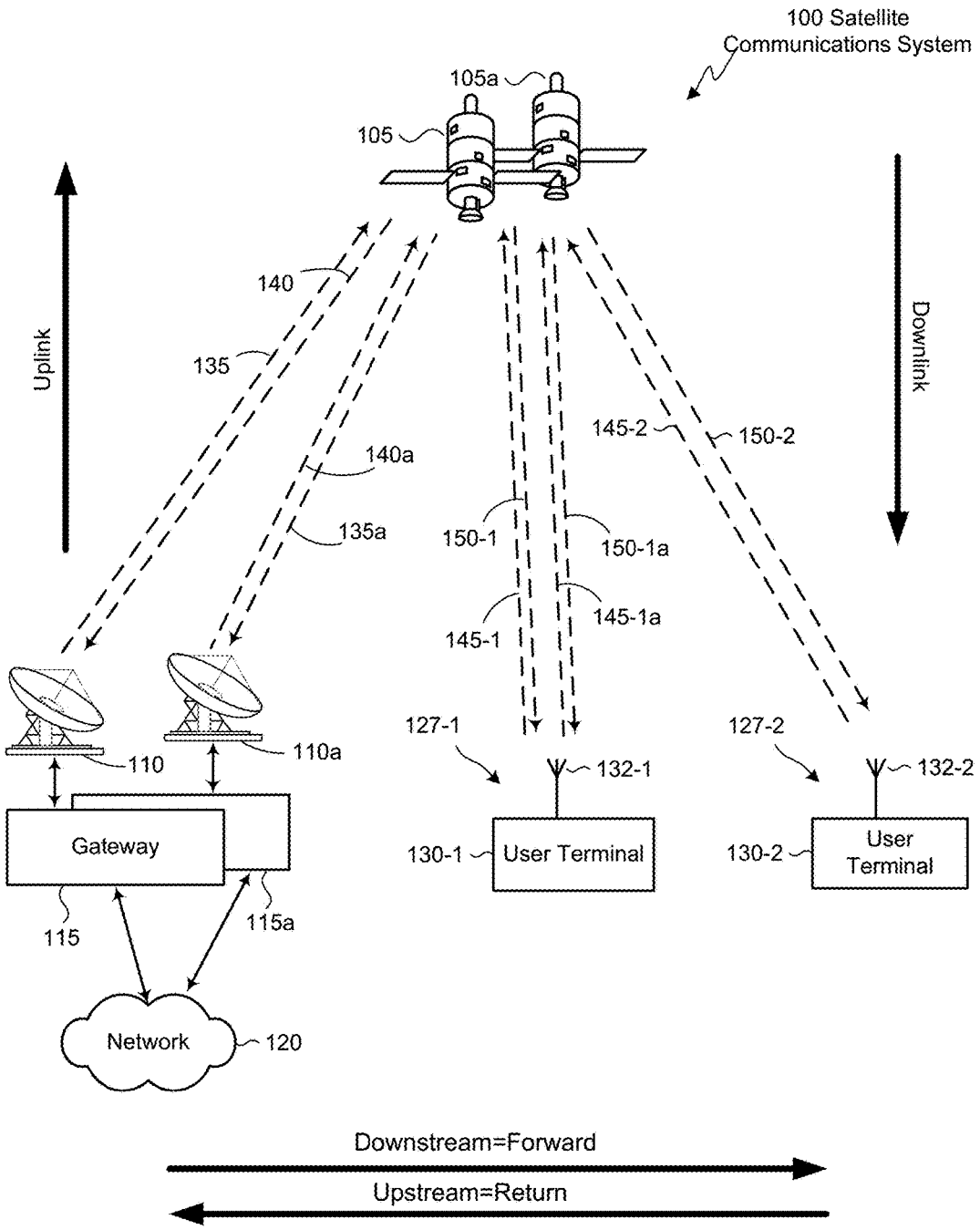
FIG. 1 is a block diagram of a satellite communication system that can be improved by various embodiments of the present disclosure.

FIG. 1 is a diagram of an example satellite communications system 100 that may be improved by systems, methods, and devices of the present disclosure. Satellite communication system 100 includes a network 120 interfaced with one or more gateway terminals 115. Gateway terminal 115 may be configured to communicate with one or more user terminals 130 via satellite 105. As used herein the term "communicate" may refer to both transmitting and receiving (i.e., bidirectional communication) or may refer to either transmitting or receiving (i.e., unidirectional communication) over a particular pathway.

Gateway terminal 115 may be referred to herein as the hub or ground station. Gateway terminal 115 may service uplink 135 and downlink 140 to and from satellite 105. Gateway terminal 115 may also schedule traffic to user terminals 130. Alternatively, the scheduling may be performed in other parts of satellite communication system 100. Communication links between gateway terminal 115 and satellite 105 may use the same, overlapping, or different frequencies as communication links between satellite 105 and user terminals 130. Gateway terminal 115 may also be located remotely from user terminals 130 to enable frequency reuse. By separating the gateway terminal 115 and user terminals 130, spot beams with common frequency bands can be geographically separated to avoid interference.

Network 120 may be any type of network and can include for example, the Internet, an IP network, an intranet, a wide area network (WAN), a local area network (LAN), a virtual private network (VPN), a virtual LAN (VLAN), a fiber optic network, a cable network, a public switched telephone network (PSTN), a public switched data network (PSDN), a public land mobile network, and/or any other type of network supporting communications between devices as described herein. Network 120 may include both wired and wireless connections as well as optical links. Network 120 may connect gateway terminal 115 with other gateway terminals that may be in communication with satellite 105 or with other satellites.

Gateway terminal 115 may be provided as an interface between network 120 and satellite 105. Gateway terminal 115 may be configured to receive data and information directed to one or more user terminals 130. Gateway terminal 115 may format the data and information for delivery to respective terminals 130. Similarly gateway terminal 115 may be configured to receive signals from satellite 105 (e.g., from one or more user terminals 130) directed to a destination accessible via network 120. In some embodiments, gateway terminal 115 may also format the received signals for transmission on network 120. In some embodiments, gateway terminal 115 may use antenna 110 to transmit forward uplink signal 135 to satellite 105. Antenna 110 may comprise a reflector with high directivity in the direction of satellite 105 and low directivity in other directions. Antenna 110 may comprise a variety of alternative configurations which include operating characteristics such as high isolation between orthogonal polarizations, high-efficiency in the operational frequency band, low noise, and the like.

Satellite 105 may be a geostationary satellite that is configured to receive forward uplink signals 135 from the location of antenna 110 using a reflector antenna. Satellite 105 may receive the signals 135 from gateway terminal 115 and forward corresponding downlink signals 150 to one or more of user terminals 130. The signals may be passed through a transmit reflector antenna (e.g., reflector antenna) to form the transmission radiation pattern (e.g., a spot beam). Satellite 105 may operate in multiple spot beam mode, transmitting and receiving a number of narrow beams directed to different regions on the earth. This allows for segregation of user terminals 130 into various narrow beams. Alternatively, the satellite 105 may operate in wide area coverage beam mode, transmitting one or more wide area coverage beams to multiple receiving user terminals 130 simultaneously.

Satellite 105 may be configured as a "bent pipe" or relay satellite. In this configuration, satellite 105 may perform frequency and polarization conversion of the received carrier signals before retransmission of the signals to their destination. A spot beam may use a single carrier, i.e. one frequency, or a contiguous frequency range per beam. In various embodiments, the spot or area coverage beams may use wideband frequency spectra. A variety of physical layer transmission modulation encoding techniques may be used by satellite 105 (e.g., adaptive coding and modulation). Satellite 105 may use on-board beamforming techniques or rely on off-board (ground based) beamforming techniques.

Satellite communication system 100 may use a number of network architectures consisting of space and ground segments. The space segment may include one or more satellites 105 while the ground segment may include one or more user terminals 130, gateway terminals 115, network operation centers (NOCs) and satellite and gateway terminal command centers. The terminals may be connected by a mesh network, a star network, or the like as would be evident to those skilled in the art.

Forward downlink signals 150 may be transmitted from satellite 105 to one or more user terminals 130. User terminals 130 may receive downlink signals 150 using antennas 127. In one embodiment, for example, antenna 127 and user terminal 130 together comprise a very small aperture terminal (VSAT), with antenna 127 measuring approximately 0.6 m in diameter and having approximately 2 W of power. In other embodiments, a variety of other types of antenna 127, including PAFR antennas, may be used as user terminals 130 to receive downlink signals 150 from satellite 105. Each of the user terminals 130 may comprise a single user terminal or, alternatively, may comprise a hub or router, not shown, that is coupled to multiple user terminals. Each user terminal 130 may be connected to various consumer electronics comprising, for example, computers, local area networks, Internet appliances, wireless networks, and the like.

In some embodiments, a multi-frequency time division multiple access (MF-TDMA) scheme may be used for upstream links 140 and 145, allowing efficient streaming of traffic while maintaining flexibility and allocating capacity among each of the user terminals 130. In these embodiments, a number of frequency channels may be allocated statically or dynamically. A time division multiple access (TDMA) scheme may also be employed in each frequency channel. In this scheme, each frequency channel may be divided into several timeslots that can be assigned to a connection (i.e., a user terminal 130). In other embodiments, one or more of the upstream links 140, 145 may be configured using other schemes, such as frequency division multiple access (FDMA), orthogonal frequency division multiple access (OFDMA), code division multiple access (CDMA), or any number of hybrid or other schemes known in the art.

User terminal 130 may transmit data and information to a network 120 destination via satellite 105. User terminal 130 may transmit the signals by upstream link 145 to satellite 105 using antenna 127. User terminal 130 may transmit the signals according to various physical layer transmission modulation encoding techniques, including for example, those defined with the DVB-S2, WiMAX, LTE, and DOCSIS standards. In various embodiments, the physical layer techniques may be the same for each of the links 135, 140, 145, 150, or they may be different.

Satellite 105 may support non-processed, bent pipe architectures with one or more reflector antennas as described herein to produce multiple small spot beam patterns. The satellite 105 can include J generic pathways, each of which can be allocated as a forward pathway or a return pathway at any instant of time. Large reflectors may be illuminated by a phased array of feeds to provide the ability to make arbitrary spot and area coverage beam patterns within the constraints set by the size of the reflector and the number and placement of the feeds. Reflector antennas may be employed for both receiving uplink signals 130, 140, transmitting downlink signals 140, 150, or both in a full duplex mode. The beam forming networks (BFN) associated with the receive (Rx) and transmit (Tx) reflector antennas may be dynamic, allowing for quick movement of the locations of both the Tx and Rx beams. The dynamic BFN may be used to quickly hop both Tx and Rx wideband beam positions.

In some embodiments, satellite communication system 100 may include co-located satellites 105, 105*a*. As used herein, the term "co-located" may refer to a separation angle between satellites 105, 105*a* to be about 1° or less. Stated another way, satellites 105, 105*a* may be deemed co-located if the angle of separation is small enough that the beam width of the signal in an upstream link (e.g., 145-1, 145-1*a*) from user terminal 130 can cover both satellites 105, 105*a*.

Each satellite 105, 105*a* may communicate with the same or different gateway terminals 115, 115*a* using respective antennas 110, 110*a* via respective upstream links 135, 135*a* and respective downstream links 140, 140*a*. For example, satellites 105, 105*a* may be operated by different communication providers, having their own infrastructure. Similarly, satellites 105, 105*a* may communicate with user terminal 130, each on its own frequency or multiple frequencies. For example, satellite 105 may communicate with user terminal 130-1 via upstream link 145-1 and downstream link 150-1, and satellite 105*a* may communicate with user terminal 130-1 via upstream link 145-1*a* and downstream link 150-1*a*.

In accordance with the present disclosure, each user terminal 130 may transmit and receive signals using an antenna 132 having a multi-band feed design (a multi-band antenna). This aspect of the present disclosure will be discussed in more detail below.

Figure 2A:
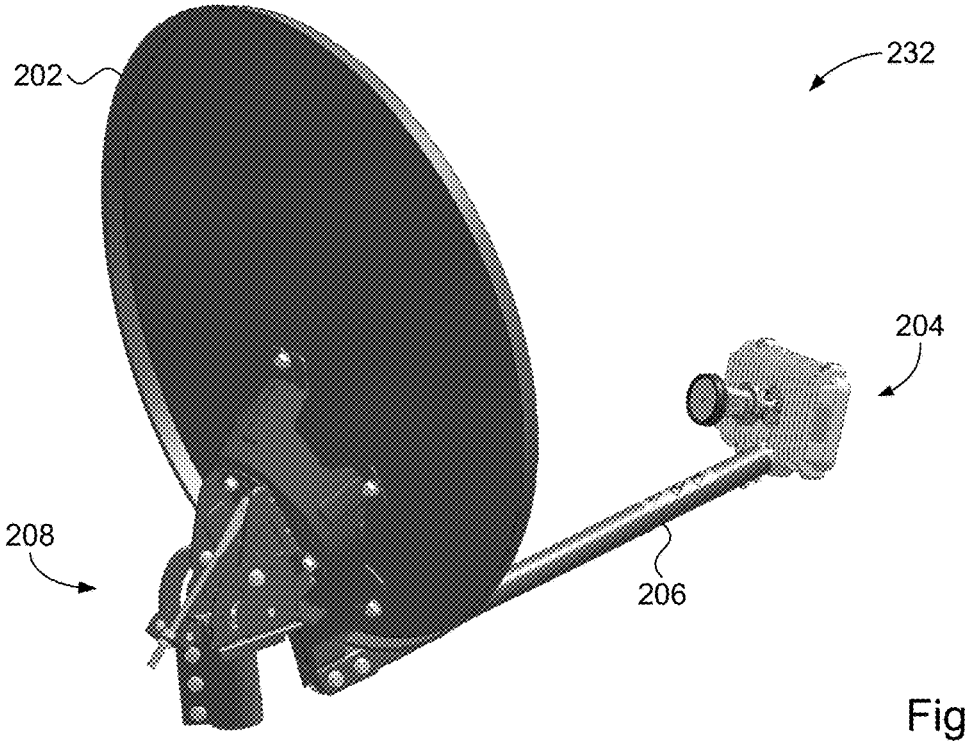
FIGS. 2A and 2B depict an illustrative embodiment of a multi-band antenna in accordance with the present disclosure.
Figure 2B:
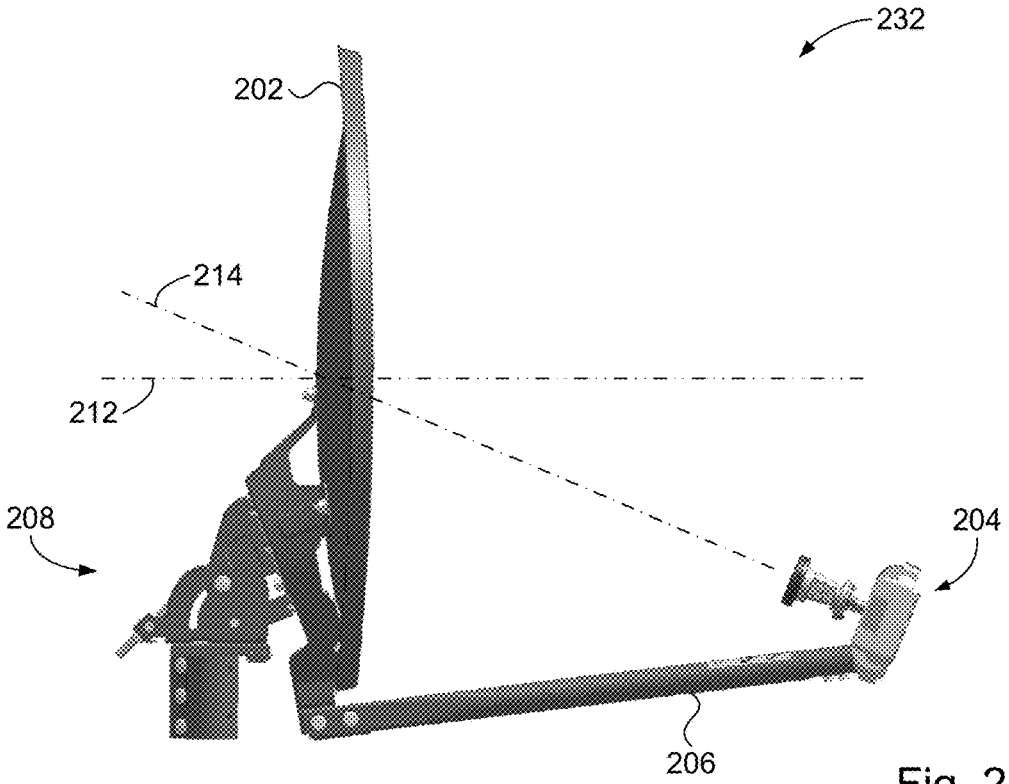

Referring to FIGS. 2A and 2B, a multi-band antenna 232 in accordance with the present disclosure may comprise a reflector 202 and a feed assembly 204. The transceiver/feed assembly 204 may be held in position relative to the reflector 202 by a support boom 206. The multi-band antenna 232 may further include a mounting bracket 208 to mount the antenna 232 to structure (e.g. a house) associated with a user terminal (e.g., 130, FIG. 1). In some embodiments, the multi-band antenna 232 may be configured as a primary offset fed antenna. For example, the transceiver/feed assembly 204 may directly illuminate the reflector 202 along a direction 214 that is off-axis relative to an axis 212 of the reflector 202.

Figure 3:
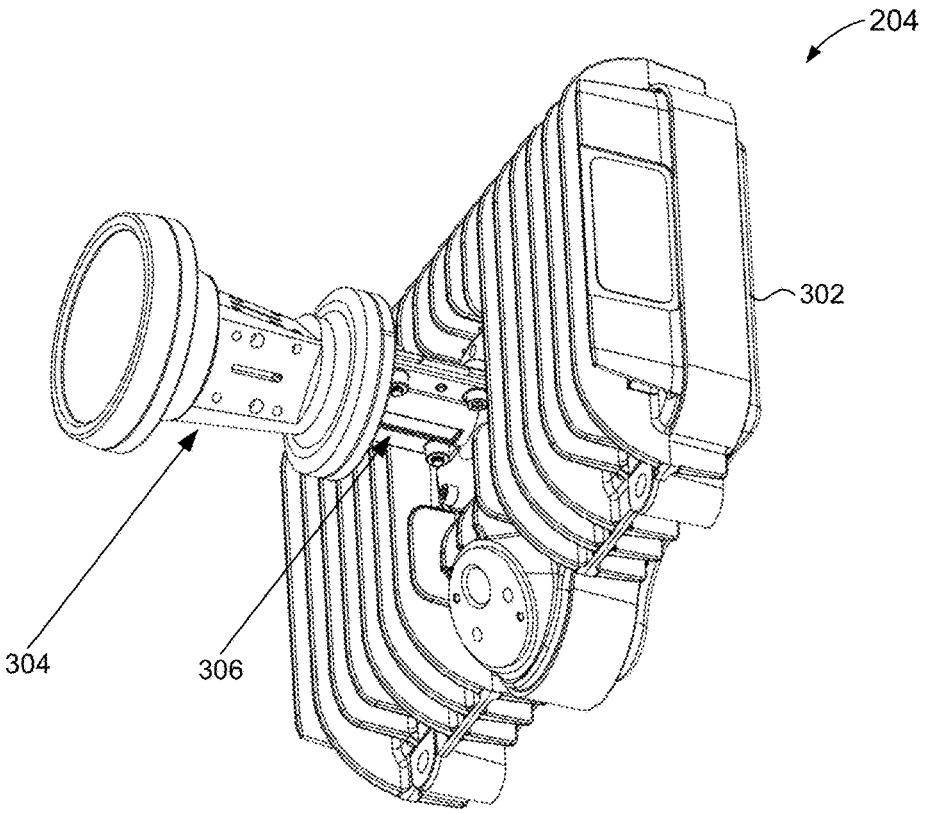
FIGS. 3 and 3A show a feed assembly in accordance with various embodiments of the present disclosure.
Figure 3A:
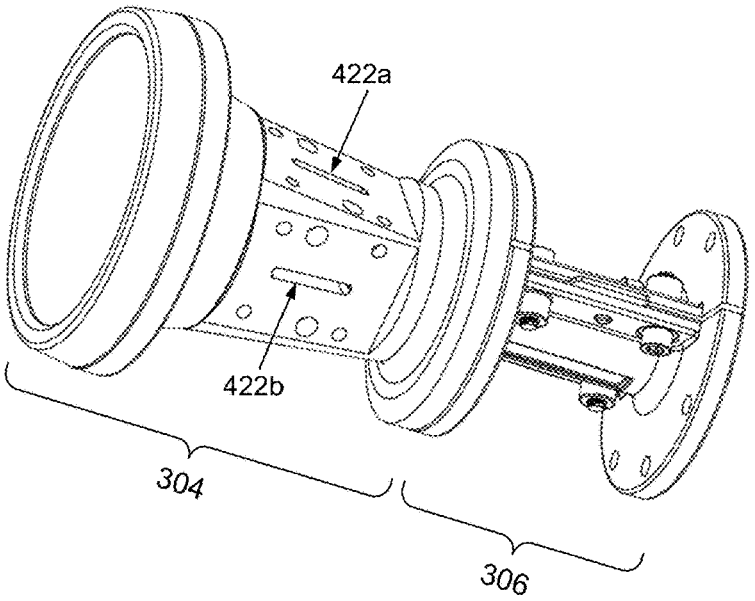

Referring to FIGS. 3 and 3A, in some embodiments, the transceiver/feed assembly 204 component of the multi-band antenna 232 (FIG. 2A) may include a transceiver module 302. The transceiver module 302 may provide signals for transmission, e.g., from a user terminal (e.g., 130, FIG. 1), to satellite 105 or co-located satellites 105, 105*a* (FIG. 1). The transceiver module 302 may also receive signals from satellite 105 or co-located satellites 105, 105*a*. The transceiver module 302 may amplify and downconvert the received signals to be processed by the user terminal. The transceiver/feed assembly 204 may further include means for propagating signals in a first frequency band and a second frequency band and means for coupling signals to the means for propagating. In some embodiments, for example, the transceiver/feed assembly 204 may include a horn assembly 304 and an in-line feed assembly 306. The in-line feed assembly 306 may couple signals between the transceiver module 302 and the horn assembly 304, including signals to be transmitted to, received from, or otherwise communicated with satellite 105 or co-located satellites 105, 105*a* (FIG. 1).

In accordance with the present disclosure, the horn assembly 304 may include means for coupling signals in the second frequency band to first and second openings formed through a sidewall of the horn assembly 304. In some embodiments, for example, the horn assembly 304 may include a first side opening (port) 422*a* (first means for feeding signals) and a second side opening 422*b* (second means for feeding signals), as illustrated in FIG. 3A for example. The first and second side openings 422*a*, 422*b* may be slotted openings formed through the horn assembly 304. As will be explained in more detail below, waveguides (not shown) may be coupled to the first and second side openings 422*a*, 422*b* of the horn assembly 304 to facilitate reception and/or transmission of signals in different frequency band than the signals communicated via the in-line feed assembly 306.

In some embodiments, the transceiver module 302 may be configured to communicate first signals in a first frequency band. In some embodiments, for example, the first signals may be in the K band, the Ka band, the K and Ka band, etc. Accordingly, in accordance with the present disclosure, the horn assembly 304 may be configured for simultaneous communication in multiple bands. In some embodiments, for example, the horn assembly 304 may propagate first signals in the K band, the Ka band, the K and Ka band. The signals may have dual circular polarization. In other embodiments, the horn assembly 304 may simultaneously propagate the first signals with second signals in a second frequency band lower than the first frequency band. In some embodiments, for example, the second signals may be in the Ku band. As will be explained, in some embodiments, the second signals may propagate through the first and second side openings 422*a*, 422*b* of the horn assembly 304. In some embodiments, signals in the second frequency band may have dual linear polarization. In other embodiments, signals in the second frequency band may have dual circular polarization.

Figure 4:
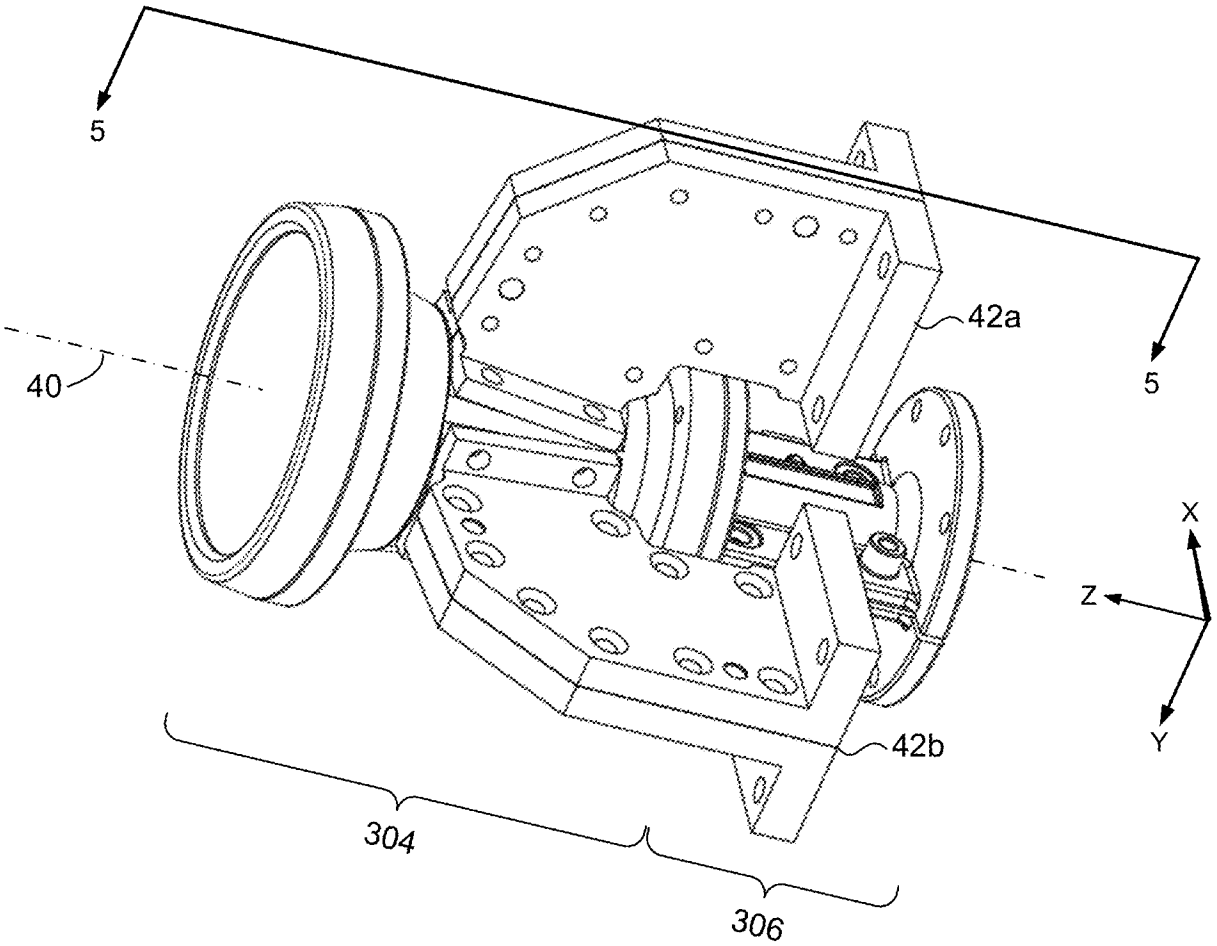
FIGS. 4 and 4A illustrate details of a feed assembly in accordance with the present disclosure.

FIG. 4 shows a perspective side view of the horn assembly 304 and in-line feed assembly 306 with illustrative first and second sidewall waveguides (feeds) 42*a*, 42*b* attached to the horn assembly 304. In accordance with the present disclosure, the first and second side openings 422*a*, 422*b* shown in FIG. 3A may be coupled to respective first and second sidewall waveguides 42*a*, 42*b*. In some embodiments, the first and second sidewall waveguides 42*a*, 42*b* may correspond to pathways for vertically polarized and horizontally polarized Ku band signals, respectively.

FIG. 4 further shows a longitudinal central axis 40 defined along a long axis of the horn assembly 304. The central axis 40 may define the direction 214 of illumination of the feed assembly 204 illustrated in FIG. 2B. An XYZ coordinate system provides a spatial reference for the cross-sectional view taken along view lines 5-5, which will be described below in connection with FIG. 5.

Figure 4A:
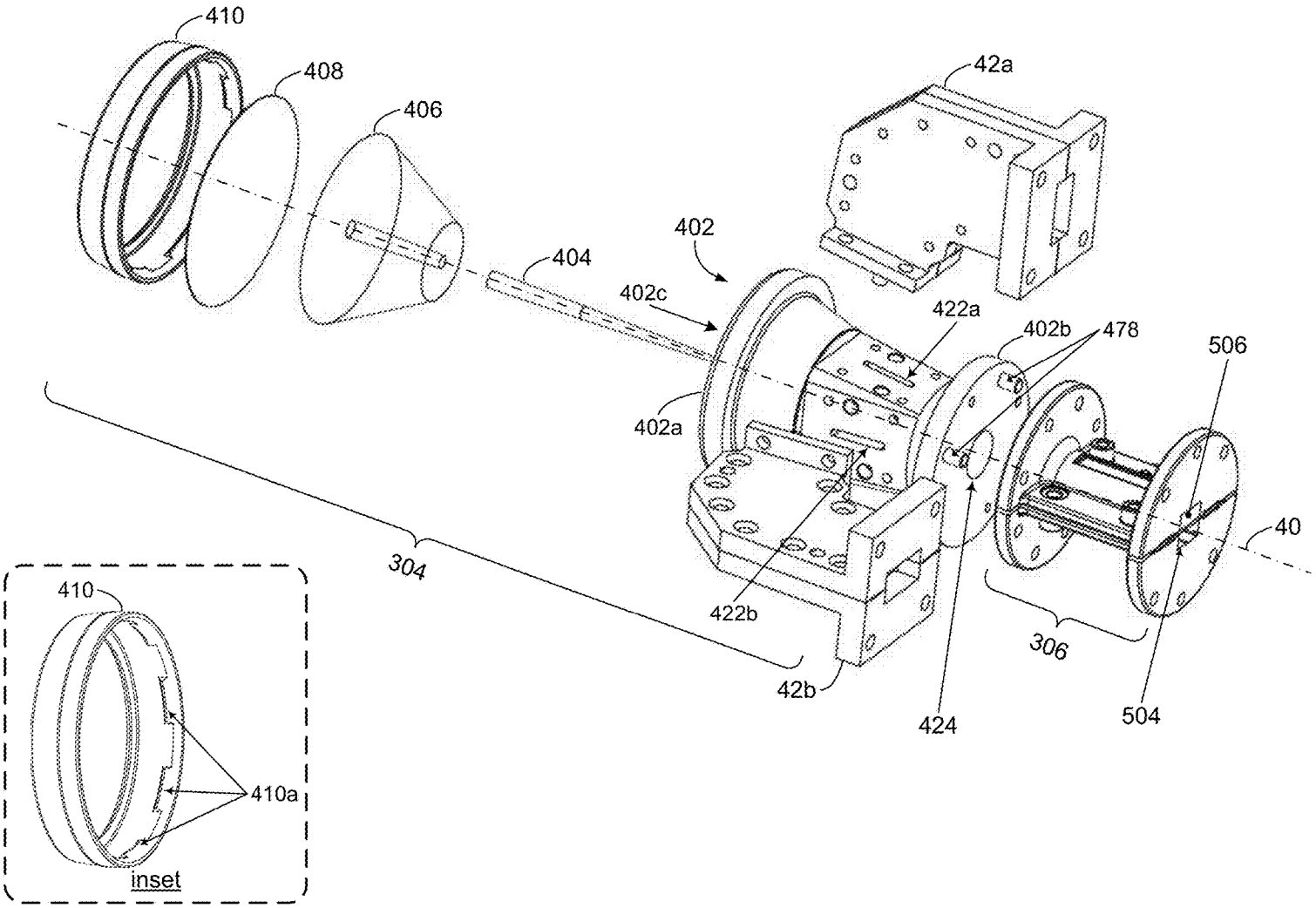

FIG. 4A depicts an exploded view of the horn assembly 304, showing various components of the horn assembly 304 in accordance with embodiments of the present disclosure. The horn assembly 304 may include a flared section 402. The horn assembly 304 may include means for reducing off-axis cross-polarization; in some embodiments, for example, a dielectric member 404 may be incorporated within an interior volume (cavity, space, etc.) of the flared section 402 along the central axis 40. A support member 406 may support the dielectric member 404 within the flared section 402. A cover (radome) 408 may serve as a close-out to protect the interior volume of the flared section 402 from environmental contaminants such as dust, moisture, and the like. A bezel 410 may snap on, screw on, or otherwise attach to the flared section 402 to hold the cover 408 in place. In other embodiments, additional sealing material (not shown) may be included to further seal off the interior volume of the flared section 402 from environmental contaminants.

In some embodiments, the bezel 410 may be a plastic material or other suitably flexible material to allow a snap fit attachment to the flared section 402. For example, the bezel 410 shown in the inset in FIG. 4A may include ridges 410*a* configured to clip onto a flange 402*a* of the flared section 402 for a secure fit. In other embodiments, the bezel 410 may be threaded (not shown) and screwed onto matching threads (not shown) formed on the flange 402*a* of the flared section 402. In other embodiments, the bezel 410 may be glued in place, and so on.

The cover 408 may be any dielectric material (e.g., a polycarbonate plastic) that is transparent to electromagnetic (EM) radiation in the frequency bands (e.g., K, Ka, Ku bands) used to communicate with the satellite 105 or co-located satellites 105, 105*a* (FIG. 1). In a particular embodiment, for example, the cover 408 may be a Lexan™ plastic disk having a thickness of about 9-10 mils. In other embodiments, the cover 408 may be formed from other materials. In some embodiments, the cover 408 may be adhesively bonded to the face of flange 402*a*. The cover 408 may further be adhesively bonded to the front face (e.g., 804, FIG. 8A) of the support member 406, and to one end of the dielectric member 404.

The dielectric member 404 may help to reduce off-axis cross-polarization in the signals. In some embodiments, the dielectric member 404 may help to confine propagation of signals in the K/Ka band along the central axis 40. By confining the K/Ka band signals along the central axis 40, such signals may be less perturbed by the first and second side openings 422*a*, 422*b*.

Typically, the beam width of the K/Ka band signals that radiate from radiating aperture 402*c* can be influenced by factors such as the size of the radiating aperture 402*c* and the flare angle at the aperture. The dielectric member 404 may reduce the influence of such factors and provide more control of the beam width of the K/Ka band signals than without the dielectric member 404.

The support member 406 may be disposed within a portion of the interior volume in the flared section 402. As will be explained in more detail below, the support member 406 may be configured to support the dielectric member 404 along the central axis 40.

In accordance with some embodiments, the first and second side openings 422*a*, 422*b* may be formed through the flared section 402. The flared section 402 may include an in-line opening (throat of the horn) 424 for communication of signals between the horn assembly 304 and the in-line feed assembly 306. Alignment pins 478 may be provided on a rear flange 402*b* of the flared section 402 to facilitate alignment of a horn-side opening 502 (FIG. 5) on the in-line feed assembly 306 to the in-line opening 424 of the flared section 402.

Figure 5:
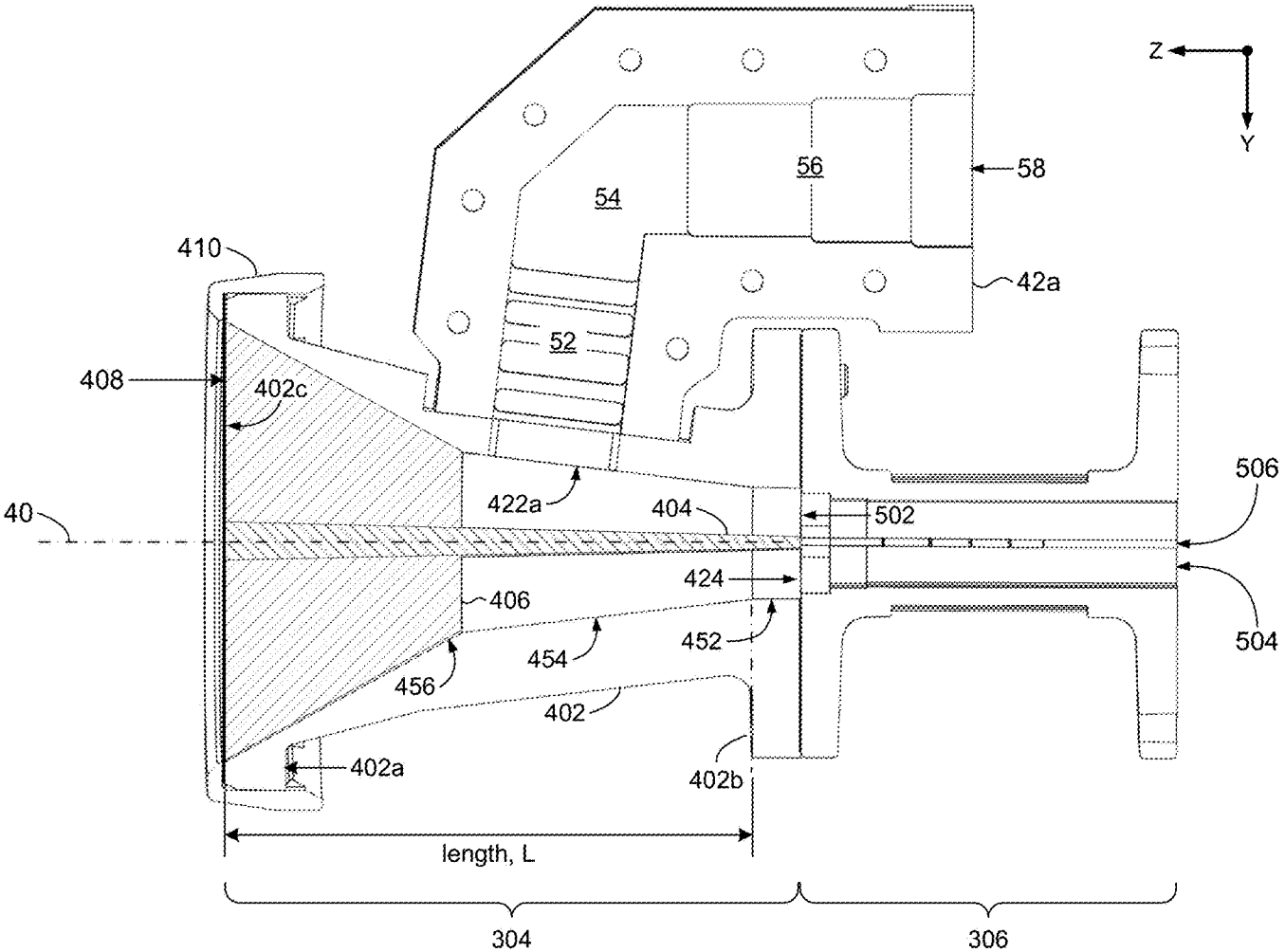
FIG. 5 shows a cross-sectional view of a feed assembly in accordance with various embodiments of the present disclosure.

FIG. 5 illustrates a cross-sectional view of the horn assembly 304 and in-line feed assembly 306 taken along view line 5-5 shown in FIG. 4. The flared section 402 may include segments (sections) 452, 454, 456. In accordance with the present disclosure, each segment 452-456 may have a different flare angle. This aspect of the present disclosure will be discussed below.

The figure shows that in some embodiments the support member 406 may be shaped for a snug fit within the interior volume defined by segment 456 of the flared section 402. The support member 406 may extend to a radiating aperture 402*c* of the flared section 402. The bezel 410 may press the cover 408 against the support member 406 and flange 402*a* to further seal off the external environment.

A portion of the dielectric member 404 may be disposed within, and thereby supported by, the support member 406. The dielectric member 404 may extend the length of the flared section 402, spanning between one end of the flared section 402 at the radiating aperture 402*c* and another end of the flared section 402 at the in-line opening 424, along the central axis 40. The remaining length of dielectric member 404 may be suspended in the interior volumes of segments 454, 452, unsupported by any structure.

The cross-sectional view of the in-line feed assembly 306 shows a transceiver-side opening 504 that can interface with a transceiver (e.g., transceiver module 302, FIG. 3). A horn-side opening 502 can interface with the horn assembly 304. More particularly, the horn-side opening 502 may align with the in-line opening 424; for example, facilitated by alignment pins 478 shown in FIG. 4A. In some embodiments, the in-line feed assembly 306 may be a polarizer that includes a septum polarizer 506 disposed along the central axis 40. Additional detail of the in-line feed assembly 306 is disclosed below.

The cross-sectional view shows the sidewall waveguide 42*a* may include a filter section 52 and an H-bend 54 to connect the filter section 52 to a stepped transition region 56. The filter section 52 may have an opening that matches the dimensions of the first side opening 422*a*.

In some embodiments, the sidewall waveguides 42*a*, 42*b* may be configured to propagate signals in the Ku band. However, the horn assembly 304 may propagate signals in the K and/or Ka band simultaneously with signals in the Ku band. Accordingly, in some embodiments, filter section 52 in each of the sidewall waveguides 42*a*, 42*b* may be configured as a low-pass waveguide filter to reject signals in the higher first frequency band (e.g., K and/or Ka bands). In other embodiments, the filter section 52 may be a band-pass type or a low-pass type filter.

An H-bend 54 may provide a suitable pathway for the signals between the horn assembly 304 and a terminal (e.g., 130, FIG. 1) connected to the horn assembly 304. In given embodiment, additional H-bends and/or E-bends (not shown) may be required to properly route the signal. The H-bend 54 may guide signals from the filter section 52 to the stepped transition region 56. In some embodiments, for example, side openings 422*a*, 422*b* may be smaller than standard waveguide dimensions. Accordingly, the stepped transition region 56 may be used to gradually increases the waveguide dimensions to a standard sized waveguide coupled to opening 58.

Figure 6:
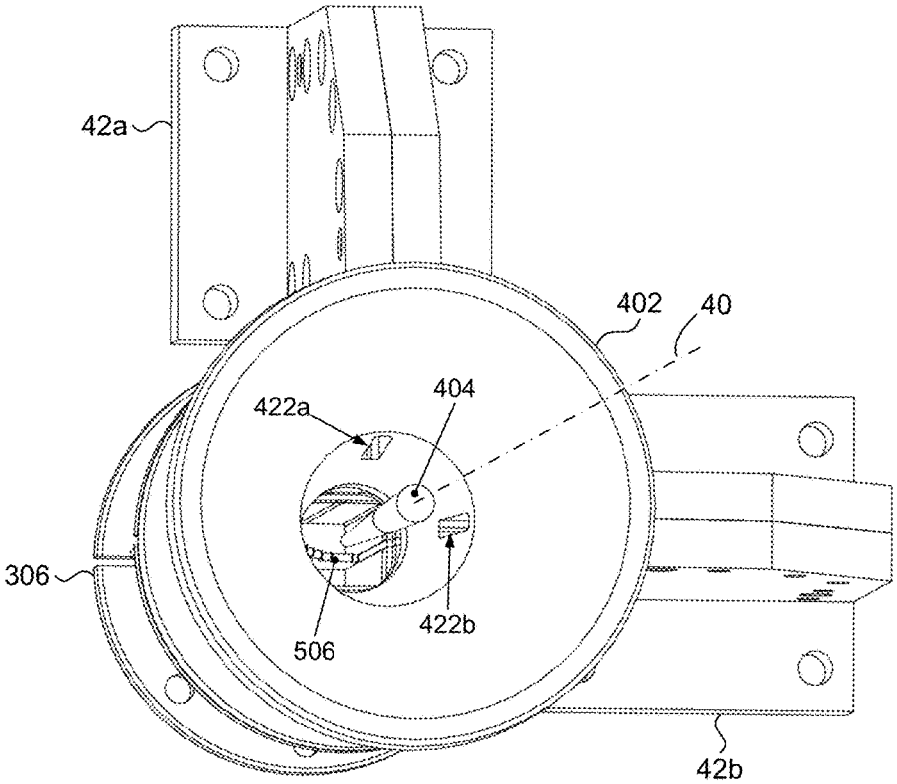
FIGS. 6, 6A, and 6B show details of a horn assembly in accordance with the present disclosure.

FIG. 6 shows a perspective view of the configuration shown in FIG. 4. The view is a front-facing perspective view looking into the flared section 402 with the bezel 410 and support member 408 omitted. The figure illustrates the relative orientation of dielectric member 404 within the interior volume of the flared section 402.

Figure 6A:
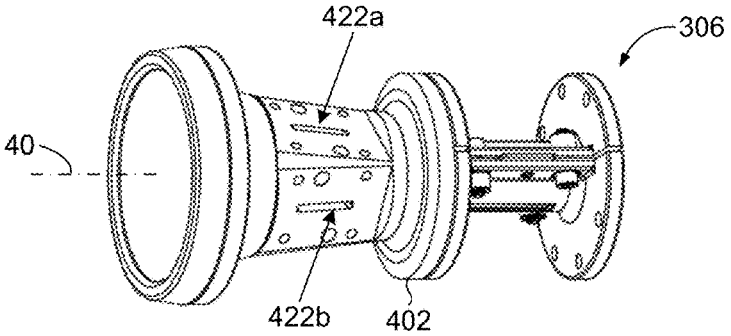
Figure 6B:
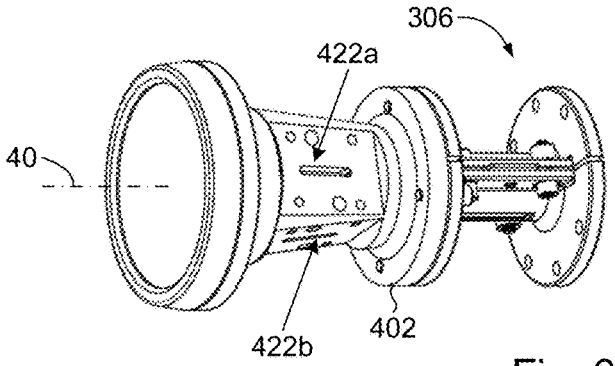

In accordance with embodiments of the present disclosure, the first and second side openings 422*a*, 422*b* may be asymmetrically radially arranged about the central axis 40. In other words, the first and second side openings 422*a*, 422*b* may be at an angle other than 180° relative to each other about the central axis 40. The embodiment shown in FIG. 6, for example, shows that the first and second side openings 422*a*, 422*b* are 90° relative to each other about the central axis 40. FIGS. 6A and 6B illustrate that the side openings 422*a*, 422*b* may be formed on the flared section 402 at different radial orientations about the central axis 40 relative to the in-line feed assembly 306.

FIGS. 7A, 7B, and 7C depict various views of the flared section 402, showing additional details of the flared section 402 in accordance with the present disclosure. In some embodiments, the flared section 402 may be a single cast part of suitable material, such as aluminum, alloys of aluminum, zinc, alloys of zinc, etc. In accordance with the present disclosure, each segment 452, 454, 456 of the flared section 402 may have respective smooth interior surfaces (walls) 702, 704, 706, as represented for example in FIGS. 7A and 7C. A single cast part can enable high-volume low-cost manufacturing methods.

FIG. 7B shows additional details of the first and second side openings 422*a*, 422*b*. In some embodiments, for example, surfaces 472*a*, 472*b* may be cut, machined, or otherwise formed into the exterior surface of the flared section 402. The first and second side openings 422*a*, 422*b* may be formed through respective surfaces 472*a*, 472*b* of the flared section 402 to the interior volume of the flared section 402. In some embodiments, alignment holes 474*a*, 474*b* may be drilled into respective surfaces 472*a*, 472*b*. The alignment holes 474*a*, 474*b* may facilitate the alignment of respective sidewall waveguides 42*a*, 42*b* (e.g., FIG. 4A) to respective first and second side openings 422*a*, 422*b*. In some embodiments, screw holes 476*a*, 476*b* may be provided to secure the respective sidewall waveguides 42*a*, 42*b* to the flared section 402. In other embodiments, the sidewall waveguides 42*a*, 42*b* may be welded (e.g., braze welding) onto the flared section 402.

The rear flange 402*b* may include alignment pins 478*a*, 478*b* to facilitate alignment of the horn-side opening 502 (FIG. 5) of the in-line feed assembly 306 to the in-line opening 424 of the flared section 402. In some embodiments, screw holes 480 may be drilled into the rear flange 402*b* to secure the in-line feed assembly 306 (FIG. 5) to the flared section 402.

The cutaway view shown in FIG. 7C is obtained by rotating the flared section 402 in the direction shown in FIG. 7B so that the first side opening 422*a* is shown in cross section. The cross-sectional view shows the segments 452, 454, 456 that comprise the flared section 402. In accordance with the present disclosure, each segment 452-456 may be characterized as a truncated cone having a vertex angle, referred herein as the flare angle, that is different from the other segments. In some embodiments, the segment 452 may be cylindrical having a flare angle of 0°. The segment 454 may have a flare angle represented by $\theta_1$, and segment 456 may have a flare angle represented by $\theta_2$ ($\neq\theta_1$). In other embodiments, the flared section 402 may include additional segments (not shown) with different flare angles.

In various embodiments, the number of segments (e.g., 452-456) and the flare angles (e.g., $\theta_1$, $\theta_2$) may be varied to achieve different degrees of compactness of the flared section 402, and hence the horn assembly 304 (e.g., FIG. 5). For example, having two segments (e.g., 454, 456) and wide flare angles ($\theta_1$, $\theta_2$) allows for a compact design; e.g., a length L of the flared section 402 that is smaller than found in conventional designs. The flare angles $\theta_1$, $\theta_2$ between segments 454 and 456 define a first transition region 712 between a first input diameter $d_1$ at the in-line opening 424 and a second intermediate diameter $d_2$, and a second transition region 714 between the second intermediate diameter $d_2$ and a third output diameter $d_3$ at the radiating aperture 402*c* of the flared section 402. In some embodiments, the length L of the flared section 402 (e.g., the sum of $L_1$ and $L_2$) may be less than twice the output diameter $d_3$ at the radiating aperture 402*c* of the horn.

In some embodiments, the first and second side openings 422*a*, 422*b* may be formed in first transition region 712. The first and second side openings 422*a*, 422*b* may be axially aligned at the same axial position along the central axis 40. The axial position of the first and second side openings 422*a*, 422*b*, for example, may be defined as a position on the central axis 40 with respect to a line 72 passing through the respective centers of the first and second side openings 422*a*, 422*b*. The axial position may depend on the frequency band of the signals that pass through the first and second side openings 422*a*, 422*b*, the number of segments (e.g., 454, 456), and the flare angles (e.g., $\theta_1$, $\theta_2$).

Figure 8A:
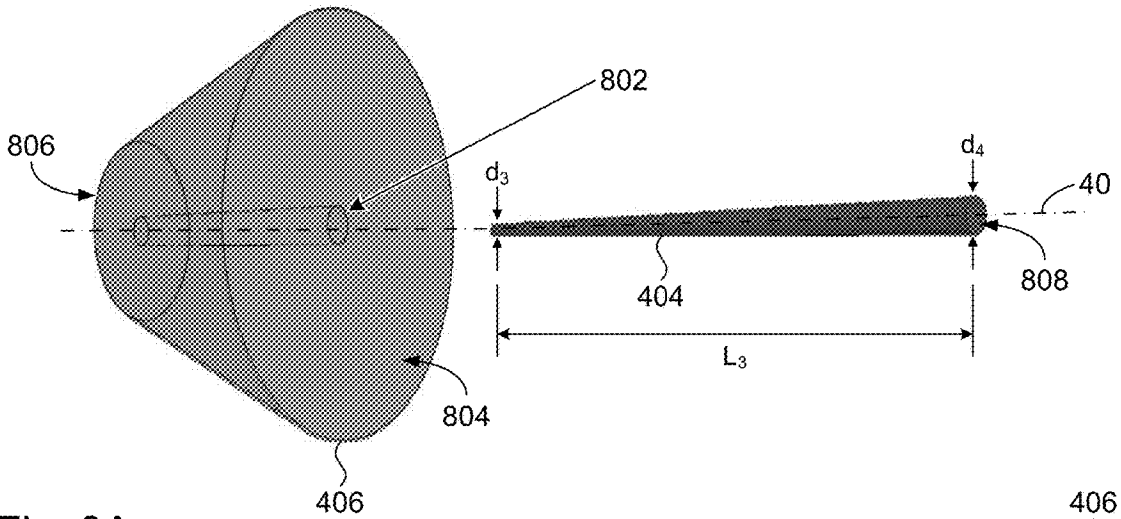
FIGS. 8A and 8B show details of dielectric components in accordance with the present disclosure.
Figure 8B:
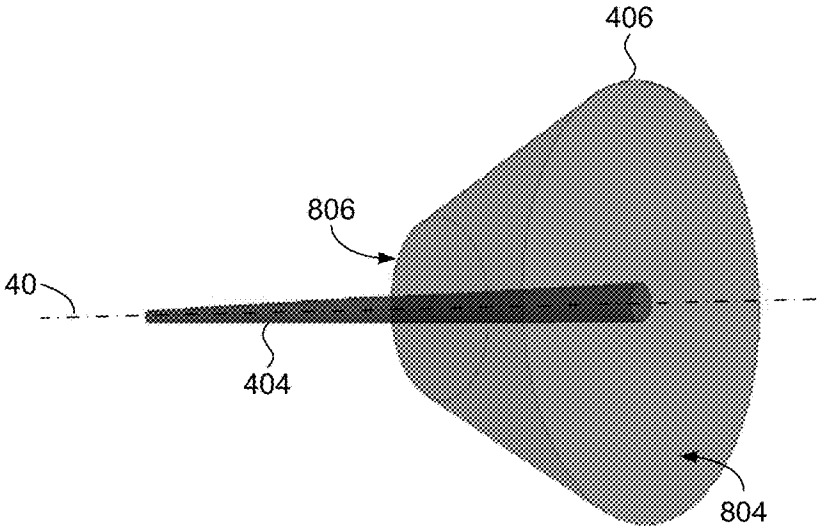

FIGS. 8A and 8B show additional details of dielectric member 404 and support member 406 shown in FIG. 4A. In some embodiments, for example, the dielectric member 404 may have a tapered rod-shaped structure. The particular embodiment depicted in FIGS. 8A and 8B show a single taper. However, it will be appreciated that in other embodiments, the dielectric member 404 may have two or more sections having tapers with different angles.

A core 802 may be provided through the support member 406 along the central axis 40. The core 802 may have a tapered profile that corresponds to the taper of the dielectric member 404. The dielectric member 404 may be inserted into the core 802 through the front face 804 of the support member 406.

The tapers in the core 802 and in the dielectric member 404 may be dimensioned so that the front face 808 of the dielectric member 404 can self-align flush with the front face 804 of the support member 406. The portion of the dielectric member 404 within the core 802 can securely align the axis of dielectric member 404 with the central axis 40. The portion of the dielectric member 404 that extends beyond the rear face 806 of the support member 406 can therefore be supported along the central axis 40 within the interior volume of segments 454, 452 of the flared section 402, without additional supporting structure as shown in FIG. 5.

In some embodiments, the tapers in the core 802 and in the dielectric member 404 may also provide a friction fit to secure the dielectric member 404 in the support member 406 without the use of adhesives or other bonding agents. In other embodiments, a suitable adhesive may be used to secure the dielectric member 404 in support member 406.

The dielectric member 404 may be formed from any suitable dielectric material. In some embodiments, for example, a Rexolite® or Ultem® plastic may be used. In general, the dielectric member 404 may comprise any material or combination of materials having suitable dielectric properties, mechanical properties, and thermal properties. The support member 406 may be a low-loss, low-dielectric constant, closed-cell foam material. In various embodiments, the support member 406 may be produced in a shape that corresponds to one or more of the segments (e.g., 452-456, FIG. 5) that comprise the flared section 402 (FIG. 5).

Figure 9C:
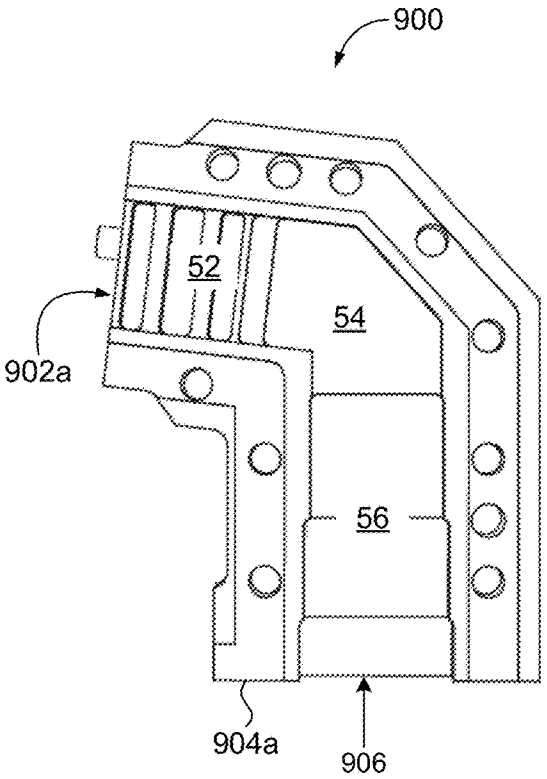
FIGS. 9A, 9B, and 9C show details of a side wall waveguide in accordance with various embodiments of the present disclosure.
Figure 9B:
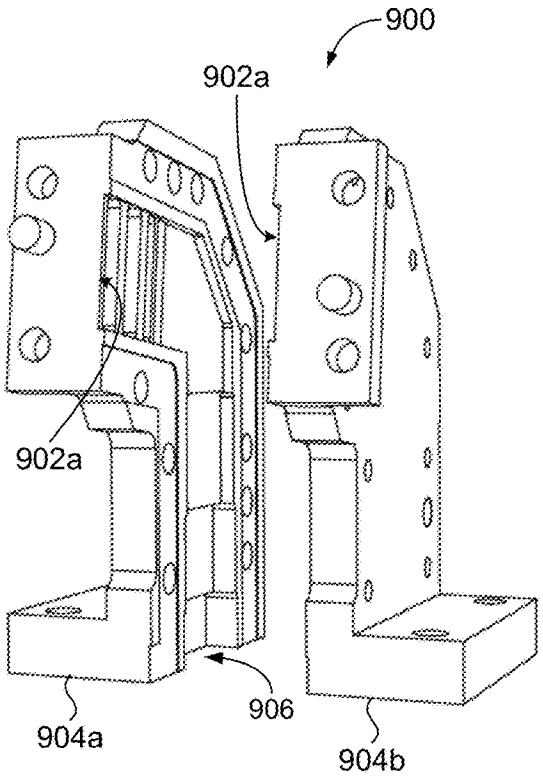
Figure 9A:
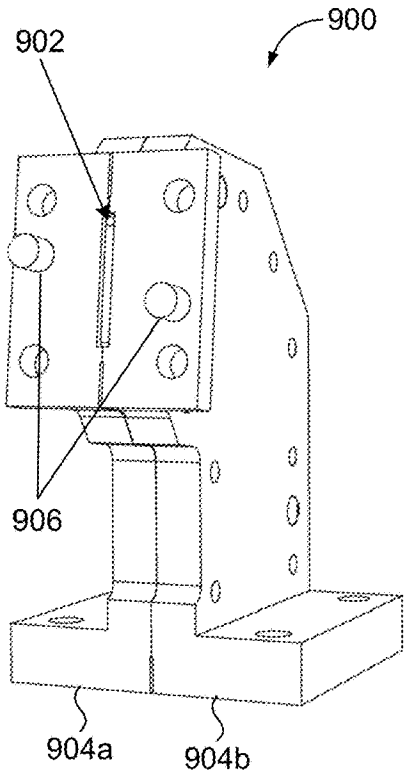
Figure 10:
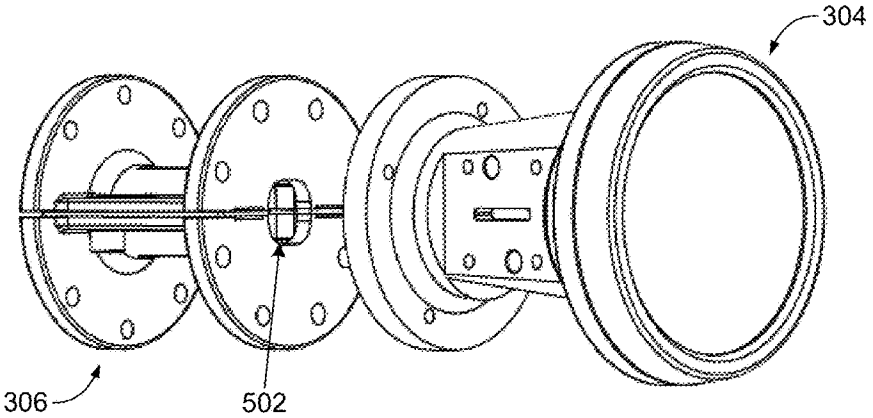
FIGS. 10, 11A, 11B, 11C, and 11D show details of an in-line feed assembly in accordance with the present disclosure.

FIGS. 9A, 9B, and 9C show additional details of the first and second sidewall waveguides 42*a*, 42*b*, shown in FIG. 4 for example. Each sidewall waveguide (feed) 900 may include a opening 902. The sidewall waveguide 900 may include alignment pins 906 that may line up with alignment holes (e.g., 474*a*, FIG. 7B) on the flared section 402 (e.g., FIG. 7B), to facilitate aligning the opening 902 to the side opening (e.g., 422*a*, FIG. 7B) of the flared section 402.

The sidewall waveguide 900 may comprise two waveguide halves 904*a*, 904*b*. The opening 902 may be defined by a notched 902*a* formed in each waveguide half 904*a*, 904*b*. The opening 58 (e.g., FIG. 5) may similarly be defined by a notch 906 formed at a base of each waveguide half 904*a*, 904*b*. The side view of waveguide half 904*a* shown in FIG. 9C illustrates an example of the filter section 52, the H-bend 56, and the stepped transition region 56 described above.

FIGS. 10, 11A, 11B, 11C, and 11D show additional details of the in-line feed assembly 306, shown in FIG. 4 for example. As mentioned above and with reference to FIG. 10, the horn-side opening 502 on the in-line feed assembly 306 may interface with the in-line opening 424 on the horn assembly 304.

With reference to FIGS. 11A-11D, in some embodiments, the in-line feed assembly 306 may be a polarizer. In a some embodiments, for example, the in-line feed assembly 306 may include waveguide housing 512 defined by a first part 512*a* and a second part 512*b*. The in-line feed assembly 306 may further include a dual-band K/Ka band septum polarizer 506 that is sandwiched between the first and second parts 512*a*, 512*b* of the waveguide housing 512. The septum polarizer 506 may define a common waveguide 514 and divided waveguides 516*a*, 516*b* within the waveguide housing 512. The common waveguide 514 may terminate at the horn-side opening 502 of the in-line feed assembly 306.

The septum polarizer 506 may divide the common waveguide 514 into divided waveguides 516*a*, 516*b* that terminate at the transceiver-side opening 504 of the in-line feed assembly 306. In some embodiments, for example, each divided waveguide 516*a*, 516*b* may carry a signal that corresponds to right hand circular polarization or left hand circular polarization in the common waveguide 514.

Figure 11B:
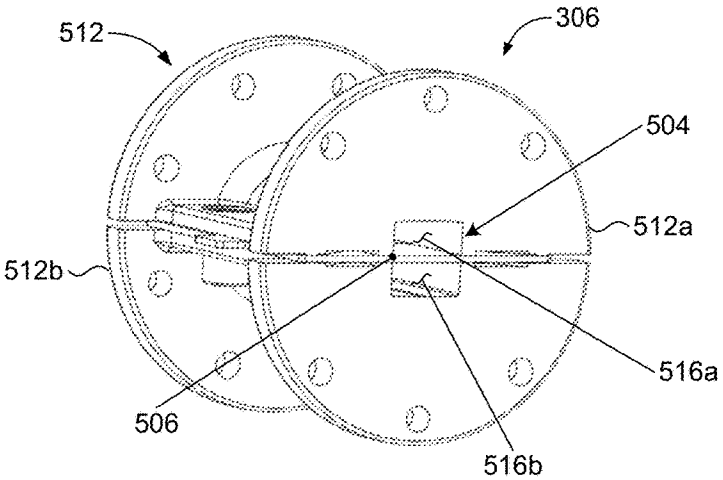
Figure 11A:
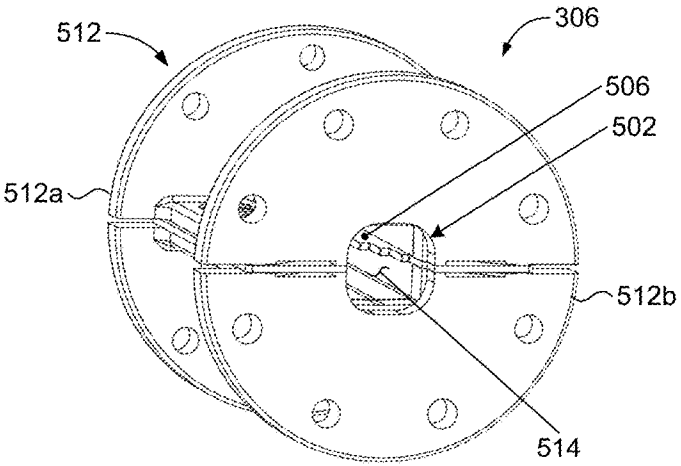
Figure 11D:
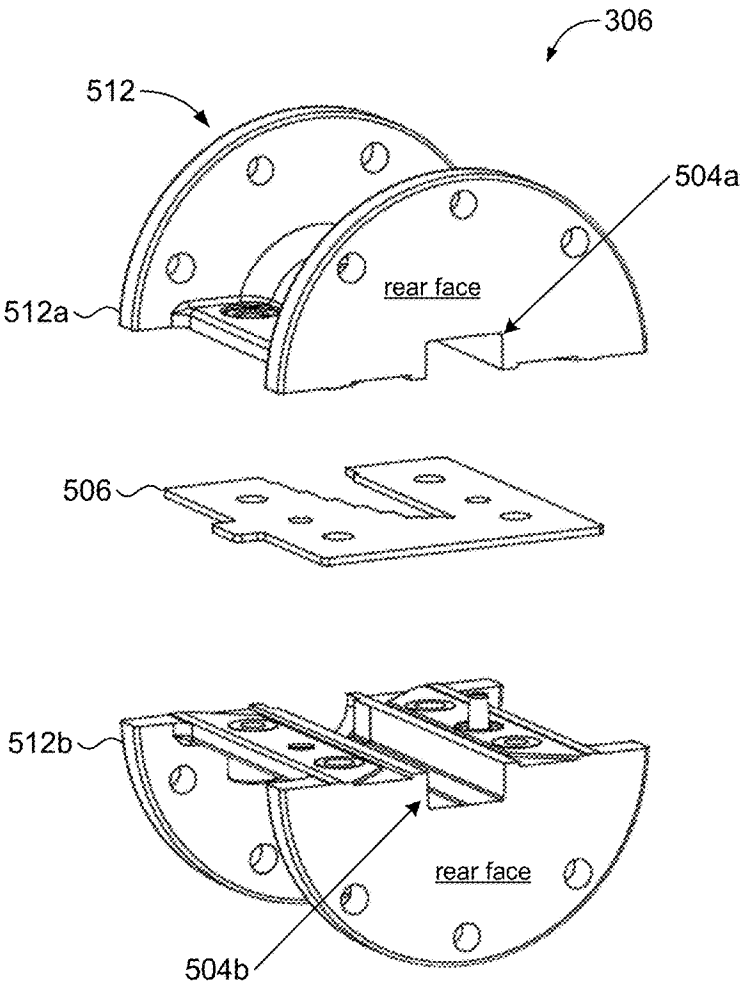
Figure 11C:
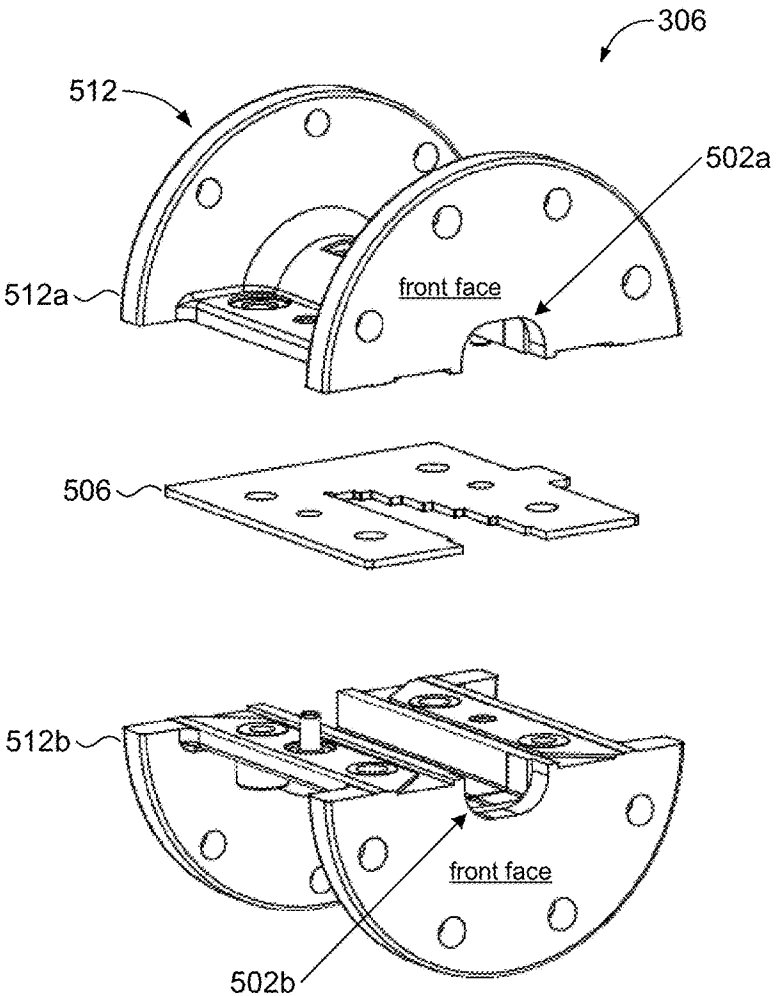

The exploded views of the in-line feed assembly 306 depicted in FIGS. 11C and 11D show that the horn-side opening 502 and the transceiver-side opening 504 can be defined in each of the first and second parts 512*a*, 512*b* of the waveguide housing 512. For example, the horn-side opening 502 may be defined by portions 502*a*, 502*b* notched out of the front faces respectively of the first and second parts 512*a*, 512*b* of the waveguide housing 512. Likewise, the transceiver-side opening 504 may be defined by portions 504*a*, 504*b* notched out of the rear faces respectively of the first and second parts 512*a*, 512*b* of the waveguide housing 512.

It will be appreciated that in accordance with the present disclosure, the in-line feed assembly 306 is not restricted to circular polarization. In some embodiments, for example, the in-line feed assembly 306 may omit the septum polarizer 506 for linearly polarized signals, namely horizontal linear polarization or vertical linear polarization.

Figure 12:
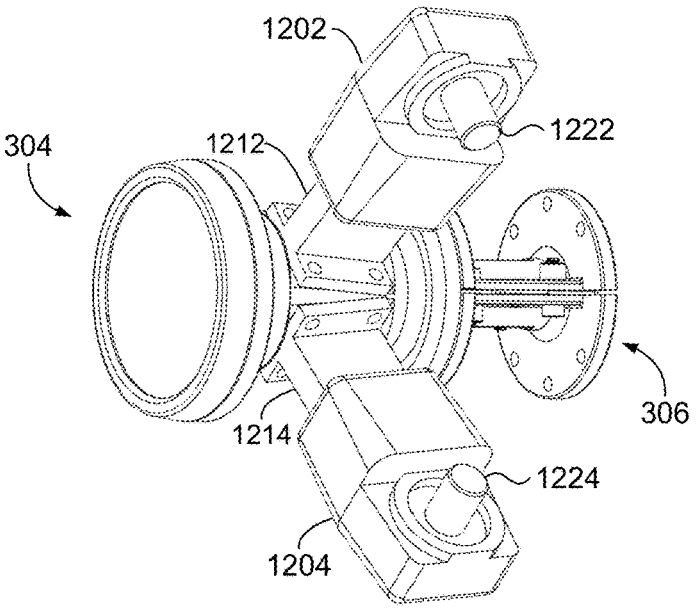
FIG. 12 shows a configuration of a horn assembly in accordance with the present disclosure coupled to LNBs.

Referring to FIG. 12, in accordance with embodiments of the present disclosure, the waveguide pathways in side openings (e.g., 422*a*, 422*b*, FIG. 3A) of horn assembly 304 can support two orthogonal linear polarizations, for example, in the Ku band. FIG. 12, for example, shows low-noise block downconverters (LNBs) 1202, 1204 to propagate linear polarized signal. Each LNB 1202, 1204 may connect to side openings (e.g., 422*a*, 422*b*, FIG. 3A) of the horn assembly 304 using respective waveguide sections 1212, 1214. In other embodiments, any suitable amplifier and downconverter module may be connected the side openings (e.g., 422*a*, 422*b*, FIG. 3A) to provide dual-linear polarized operation.

In some embodiments, the waveguide sections 1212, 1214 may be integral with their respective LNB feeds 1202, 1204. In other embodiments, the waveguide sections 1212, 1214 may be separate components from LNBs 1202, 1204. Each LNB 1202, 1204 may include a respective coaxial connector 1222, 1224 for connecting to a terminal device (not shown). LNB 1202 can provide a linear polarized signal to its respective side opening (e.g., 422*a*, FIG. 3A) on the horn assembly 304, and likewise, LNB 1204 can provide an orthogonal linear polarized signal to its respective side opening (e.g., 422*b*, FIG. 3A) on the horn assembly 304.

Figure 13:
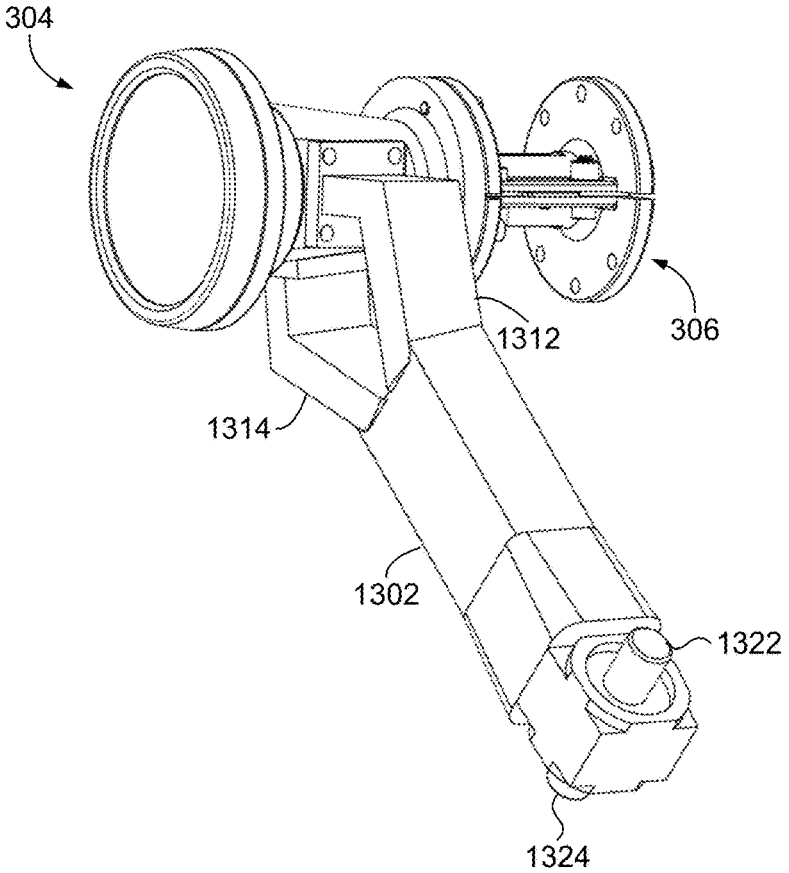
FIG. 13 shows a configuration of a horn assembly in accordance with the present disclosure coupled to a quadrature hybrid coupler.

Referring to FIG. 13, in some embodiments, the horn assembly 304 may be coupled to a quadrature hybrid coupler 1302 to convert between dual-circular polarization and dual-linear polarization, for example, in the Ku band. The quadrature hybrid coupler 1302 may include two waveguide couplers 1312, 1324 to couple to respective side openings (e.g., 422*a*, 422*b*, FIG. 3A) of the horn assembly 304. The quadrature hybrid coupler 1302 may include coax connectors 1322, 1324 for connection to a terminal (not shown).

In some embodiments such as shown in FIG. 13, the horn assembly 304 may use a 4 dB (unequal amplitude) quadrature hybrid coupler 1302 rather than the more common 3 dB (equal amplitude) quadrature hybrid coupler. The 4 dB coupler 1302 (or other non-3 dB coupler) may optimize Ku band cross-polarization discrimination performance that may result from the two side opening arrangement (e.g., 422*a*, 422*b*, FIG. 3A) of the horn assembly 304.

Figure 14:
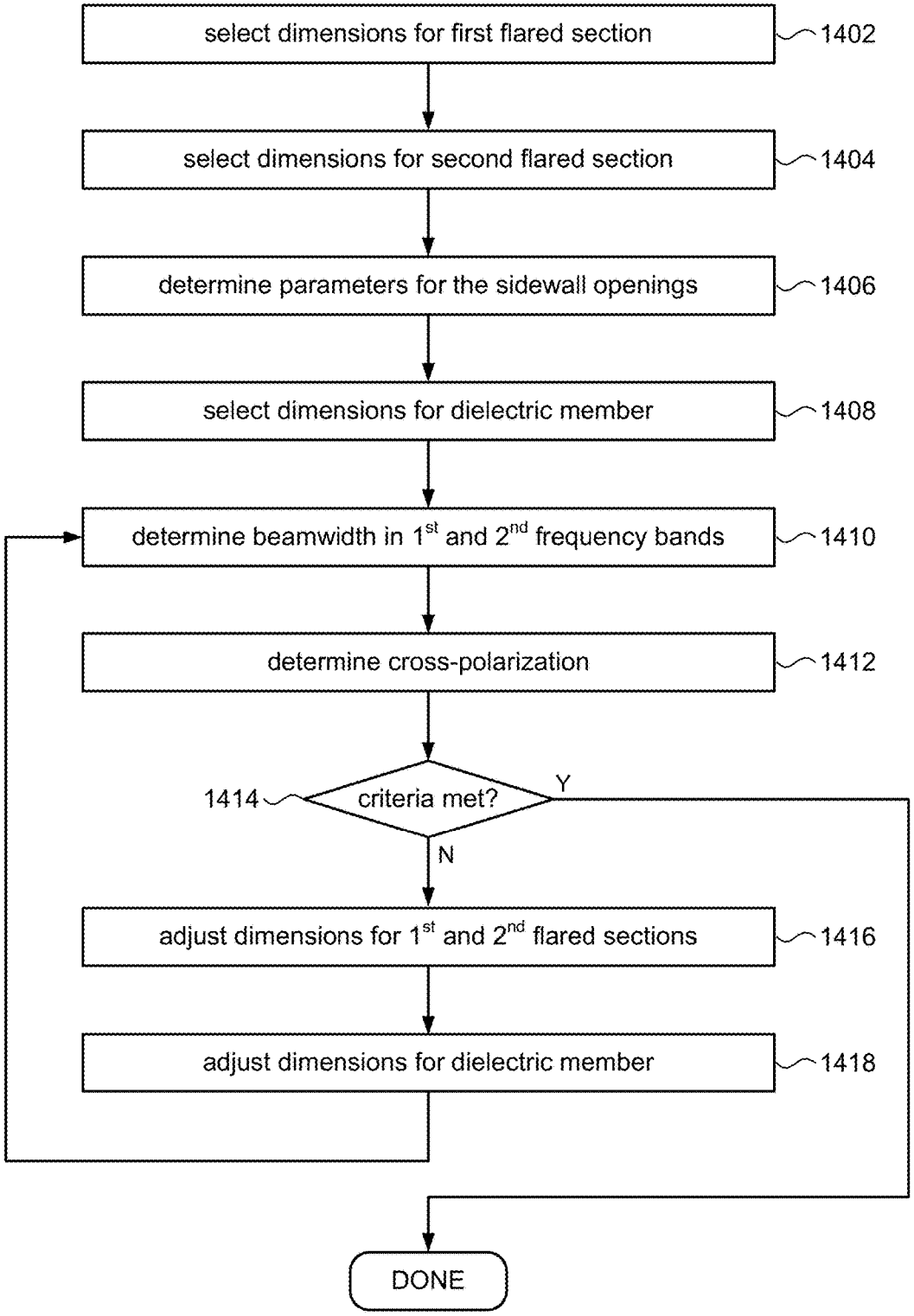
FIG. 14 shows a process flow for designing a multi-band antenna in accordance with the present disclosure.

Referring to FIG. 14, a process for designing a multi-band antenna (e.g., 232, FIG. 2A) in accordance with the present disclosure will be discussed. The design process may include the design for a horn assembly (e.g., 304, FIG. 3A). In some embodiments, the process may be performed using suitable simulation tools. The horn assembly may be designed using, for example, the High Frequency Structure Simulator (HFSS) software available from Ansys, Inc. It will be appreciated that other simulation software may be used.

The process will be explained with respect to the horn assembly illustrated in FIGS. 7C and 8A as examples.

At block 1402, a first flared section (e.g., 454) of a flared member (e.g., 402) of the horn assembly may be designed, for example, by selecting an initial length dimension $L_1$ and a flare angle $\theta_1$ measured relative to a central axis 40. The flare angle may be defined by selecting sizes for the openings (e.g., $d_1$, $d_2$) of the first flared section. As noted above, in accordance with some embodiments, of the present disclosure, signals in a first frequency band (e.g., K band, Ka band) may propagate along the central axis of the horn, while signals in a second frequency band lower that the first frequency band (e.g., Ku band) may propagate through sidewalls in the horn. Accordingly, in some embodiments, the opening $d_1$ at the throat (e.g., 424) of the horn may be small enough to cut off propagation of signals in the second frequency band so that they do not propagate all the way through the throat.

At block 1404, the design for a second flared section (e.g., 456) of the flared member may include selecting an initial length dimension $L_2$ and a flare angle $\theta_2$ measured relative to the central axis 40. In some embodiments, one opening of the second flared section may be fixed by the opening $d_2$ in first flared section. Accordingly, the flare angle in the second flared section may be defined by selecting a size for the other opening (e.g., $d_3$) of the second flared section.

At block 1406, design parameters may be selected for the sidewall openings (e.g., 422*a*, 422*b*). The sidewall openings may be formed in the first or second flared sections. In accordance with the present disclosure, the sidewall openings may be asymmetrically arranged about the central axis 40. In some embodiments, for example, the sidewall openings may be 90° apart. Design parameters for the sidewall openings may include their axial position, the axial length of the opening and the width of the openings. These parameters may depend considerations such as the size of the feeds used with the horn assembly, and the like.

At block 1408, initial dimensions for a dielectric member (e.g., 404) may be selected. The length (e.g., $L_3$) of the dielectric member may be determined by the lengths of the first and second flared sections described above. The cross-sectional design of the dielectric member may be defined by selecting diameters (e.g., $d_3$, $d_4$) at the ends of the dielectric member.

At block 1410, simulations of the horn may be performed using the selected design parameters. In some embodiments, for example, simulations may be run for signals in a first frequency band and signals in a second frequency band. In particular, respective beamwidth metrics for the first and second signals to a simulated target (e.g., a satellite) may be determined from the simulations. For example, a first beamwidth metric may be computed or otherwise determined for a first beam across a first frequency band. Likewise, a second beamwidth metric for a second beam across a second frequency band may be computed or otherwise determined. In some embodiments, several beamwidth metrics for the first beam may be computed or otherwise determined at each of several beam angles, and likewise for the second beam.

At block 1412, simulations may be performed to determine a cross-polarization metric of the first beam and the second beam along the central axis through the length of the horn, between the throat (e.g., 424) of the horn and the aperture (e.g., 402*c*) of the horn. In some embodiments, a cross-polarization metric may be computed or otherwise determined at each of several beam angles.

At block 1414, the metrics obtained at blocks 1410 and 1412 may be assessed against various criteria, for example, to assess a performance of the horn design. In some embodiments, for example, the first and second beamwidth metrics (block 1410) may be compared against criteria such as predetermined targets. A passing criterion, for example, may be that the first beamwidth metric is equal to a first predetermined beamwidth target, or at least falls within a range (e.g., +/− percentage) of the first predetermined beamwidth target. Likewise, a passing criterion for the second beamwidth, may be that the second beamwidth metric is equal to a second predetermined beamwidth target or at least falls within a range (e.g., +/− percentage) of the second predetermined beamwidth target.

In some embodiments, where several first and second beamwidth metrics are determined at different beam angles, each of the first beamwidth metrics and the second beamwidth metrics may be assessed against the respective first predetermined beamwidth target and second predetermined beamwidth target. In other embodiments, a beamwidth targets may be defined for each beam angle.

Likewise, a particular target value of cross-polarization may be used to assess cross-polarization performance of the dielectric member design. In some embodiments, for example, the cross-polarization target value may be met if the cross-polarization metric determined at 1412 is less than or equal to the cross-polarization target value.

In some embodiments, where a cross-polarization is determined for different beam angles, a particular target value of cross-polarization may be defined for each beam angle. A passing criterion may be that the cross-polarization metric is less than or equal to the cross-polarization target value at each of the beam angles.

If the criteria at block 1414 are met, then the design process may be deemed completed. If the criteria are not met, then processing may proceed to blocks 1416 and 1418. For example, at block 1416 the design parameters (e.g., length, flare angle) for the first and second flared sections may be adjusted. The design parameters may be adjusted in several ways with each iteration. In some embodiments, for example, the dimensions for both flared sections may be adjusted with each iteration. In other embodiments, the dimensions for one flared section may be adjusted in a series of iterations until the criteria for that flared section are met, and then adjusting the dimensions for the other flared section in a second series of iterations. In still other embodiments, the design parameters may be changed in other ways with each iteration.

Similarly at block 1418, the design of the dielectric member may be adjusted and processing may proceed to block 1410 for another iteration of the design process. For example, the diameter at either or both ends of the dielectric member may be changed with each iteration in the design process.

Figure 15:
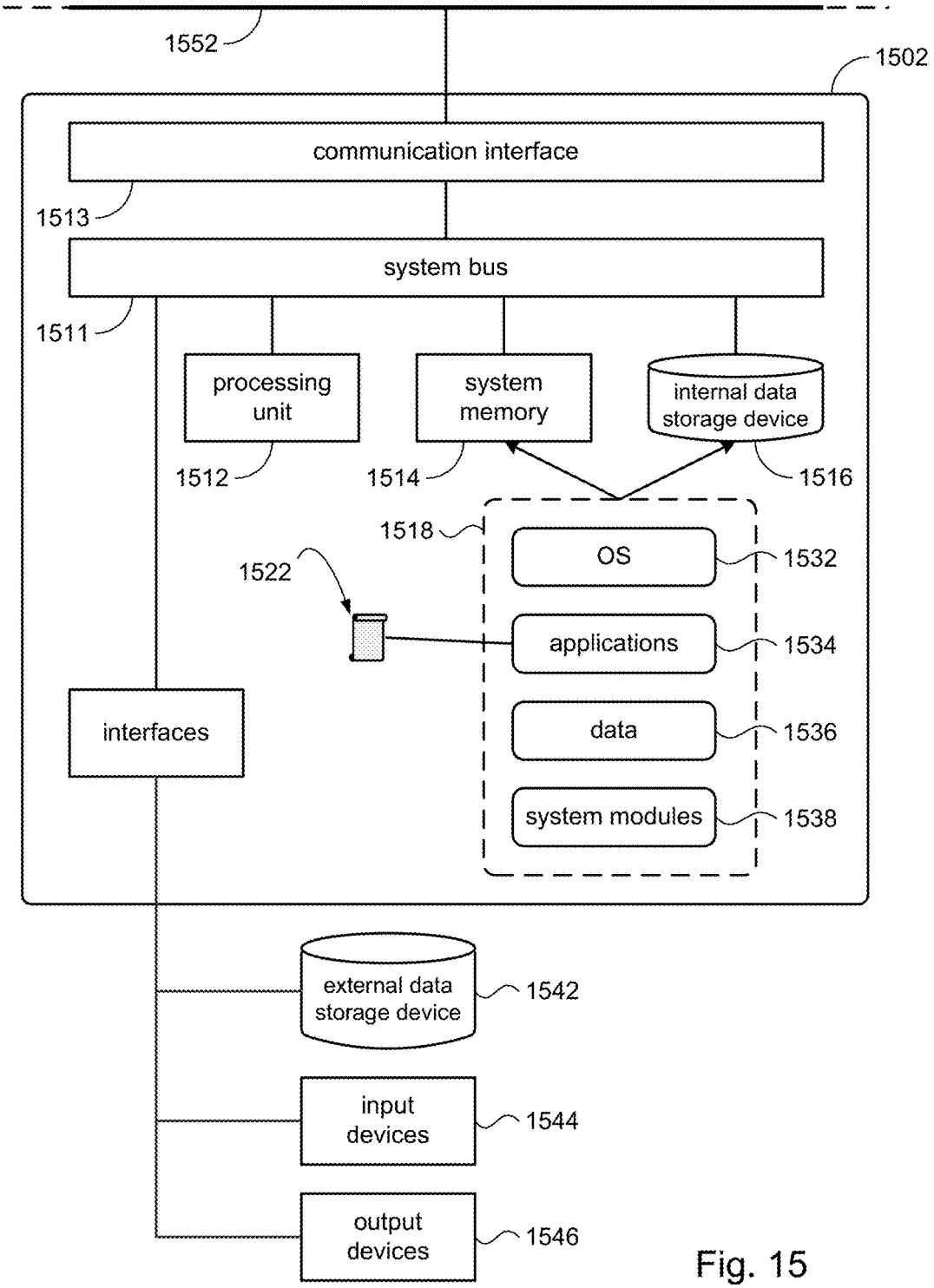
FIG. 15 illustrates an example of design system in accordance with the present disclosure.

Referring to FIG. 15, an illustrative implementation of a design system to facilitate the design of a multi-band antenna (e.g., 232, FIG. 2A), and in particular the horn assembly (e.g., 304, FIG. 3A) may include a computer system 1502 having a processing unit 1512, a system memory 1514, and a system bus 1511. The system bus 1511 may connect various system components including, but not limited to, the processing unit 1512, the system memory 1514, an internal data storage device 1516, and a communication interface 1513.

The processing unit 1512 may comprise a single-processor configuration, or may be a multi-processor architecture. The system memory 1514 may include read-only memory (ROM) and random access memory (RAM). The internal data storage device 1516 may be an internal hard disk drive (HDD), a magnetic floppy disk drive (FDD, e.g., to read from or write to a removable diskette), an optical disk drive (e.g., for reading a CD-ROM disk, or to read from or write to other high capacity optical media such as the DVD, and so on).

The internal data storage device 1516 and its associated non-transitory computer-readable storage media provide nonvolatile storage of data, data structures, computer-executable instructions, and so forth. Although the description of computer-readable media above refers to a HDD, a removable magnetic diskette, and a removable optical media such as a CD or DVD, it is noted that other types of media which are readable by a computer, such as zip drives, magnetic cassettes, flash memory cards, cartridges, and the like, may also be used, and further, that any such media may contain computer-executable instructions for performing the methods disclosed herein.

The system memory 1514 and/or the internal data storage device 1516 may store a number of program modules, including an operating system 1532, one or more application programs 1534, program data 1536, and other program/system modules 1538. For example, the application programs 1534, which when executed, may cause the computer system 1502 to perform method steps of FIG. 14. The application programs 1534 may also include simulation software (e.g., the HFSS software mentioned above). An external data storage device 1542 may be connected to the computer system 1502, for example, to store the design data for a feed or feed array.

Access to the computer system 1502 may be provided by a suitable input device 1544 (e.g., keyboard, mouse, touch pad, etc.) and a suitable output device 1546, (e.g., display screen). In a configuration where the computer system 1502 is a mobile device, input and output may be provided by a touch sensitive display.

The computer system 1502 may operate in a networked environment using logical connections via wired and/or wireless communications to one or more remote computers (not shown) over a communication network 1552. The communication network 1552 may be a local area network (LAN) and/or larger networks, such as a wide area network (WAN).

The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. A multi-band antenna comprising:

a horn to communicate signals in a first frequency band and a second frequency band, the first frequency band higher than the second frequency band;

an in-line feed; and a single pair of sidewall feeds consisting of a first side feed and a second side feed, the first and second side feeds associated with orthogonal polarizations respectively, the horn comprising:

a flared section comprising a plurality of transition regions between a first end and a second end, each transition region of the plurality of transition regions having a different flare angle and having a smooth interior surface;

an in-line opening at the first end of the flared section and arranged along a central axis of the horn, the in-line feed coupled to the in-line opening to communicate signals in the first frequency band;

first and second openings coupled to the first side feed and second side feed respectively to communicate the signals in the second frequency band, the first and second openings extending through the smooth interior surface of one of the transition regions and arranged asymmetrically about the central axis of the horn; and a dielectric member along the central axis of the horn and extending through each of the plurality of transition regions of the flared section.

2. The multi-band antenna of claim 1, wherein the plurality of transition regions consists of a first transition region and a second transition region.

3. The multi-band antenna of claim 1, wherein a length of the flared section is less than twice an output diameter of the horn.

4. The multi-band antenna of claim 1, further comprising a transceiver coupled to the in-line feed.

5. The multi-band antenna of claim 1, wherein the first and second side feeds are 90° apart.

6. The multi-band antenna of claim 1, wherein the first and second openings are elongated along the central axis of the horn.

7. The multi-band antenna of claim 1, wherein the first and second openings are aligned with each other along the central axis of the horn.

8. The multi-band antenna of claim 1, further comprising a reflector oriented relative to the horn to define a first beam associated with the first frequency band and a second beam associated with the second frequency band, the first beam and the second beam pointed in the same direction.

9. The multi-band antenna of claim 1, wherein the first and second side feeds further comprise waveguide filter sections adjacent to the first and second openings respectively.

10. The multi-band antenna of claim 1, further comprising first and second amplifiers and downconverters connected respectively to the first and second side feeds to provide dual-linear polarized operation.

11. The multi-band antenna of claim 1, further comprising a quadrature hybrid coupler connected to the first and second side feeds to provide dual-circular polarization operation.

12. The multi-band antenna of claim 11, wherein the quadrature hybrid coupler is an unequal amplitude hybrid.

13. The multi-band antenna of claim 1, wherein the inline feed includes a septum polarizer coupled between the in-line opening and first and second waveguides associated with first and second polarizations respectively.

14. The multi-band antenna of claim 1, wherein the first frequency band includes either or both a K band and a Ka band, and the second frequency band includes a Ku band.

15. The multi-band antenna of claim 1, further comprising a support member disposed in the second transition section to support the dielectric member, the support member comprising material having a lower dielectric constant than material of the dielectric member.

* * * * *